US009666128B2

(12) United States Patent
Jeong

(10) Patent No.: US 9,666,128 B2
(45) Date of Patent: May 30, 2017

(54) ELECTROLUMINESCENT DISPLAY FOR ADAPTIVE VOLTAGE CONTROL AND METHOD OF DRIVING ELECTROLUMINESCENT DISPLAY

(71) Applicant: Samsung Display Co., Ltd., Yongin, Gyeonggi-Do (KR)

(72) Inventor: Il-Hun Jeong, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 34 days.

(21) Appl. No.: 14/701,246

(22) Filed: Apr. 30, 2015

(65) Prior Publication Data

US 2016/0180771 A1 Jun. 23, 2016

(30) Foreign Application Priority Data

Dec. 18, 2014 (KR) ..... 10-2014-0182913

(51) Int. Cl.

| | |
|---|---|
| ***G09G 3/32*** | (2016.01) |
| ***G09G 3/3233*** | (2016.01) |
| ***G09G 3/3258*** | (2016.01) |
| ***G09G 3/20*** | (2006.01) |
| *G09G 3/3291* | (2016.01) |

(52) U.S. Cl.

CPC ..... *G09G 3/3233* (2013.01); *G09G 3/2003* (2013.01); *G09G 3/3258* (2013.01); *G09G 3/3291* (2013.01); *G09G 2300/043* (2013.01); *G09G 2300/0426* (2013.01); *G09G 2300/0861* (2013.01); *G09G 2300/0871* (2013.01); *G09G 2320/029* (2013.01); *G09G 2320/0223* (2013.01); *G09G 2330/021* (2013.01)

(58) Field of Classification Search

CPC ..... G09G 3/3233; G09G 3/10
USPC ..... 345/82, 76; 315/169.1
See application file for complete search history.

(56) References Cited

U.S. PATENT DOCUMENTS

| | | | | |
|---|---|---|---|---|
| 7,839,367 | B2 * | 11/2010 | Fish | G09G 3/3233 345/55 |
| 2005/0068270 | A1 | 3/2005 | Awakura | |
| 2005/0083270 | A1 * | 4/2005 | Miyazawa | G09G 3/3233 345/76 |

(Continued)

FOREIGN PATENT DOCUMENTS

| | | | |
|---|---|---|---|
| EP | 1 227 466 | A2 | 7/2002 |
| JP | 2008-256827 | A | 10/2008 |

(Continued)

*Primary Examiner* — Van Chow
(74) *Attorney, Agent, or Firm* — Knobbe Martens Olson & Bear LLP

(57) ABSTRACT

An electroluminescent display for adaptive voltage control and method of driving electroluminescent display are disclosed. In one aspect, the method includes digitally driving a display panel including a plurality of pixels based on a first power supply voltage, a second power supply voltage lower than the first power supply voltage, a first data voltage and a second data voltage lower than the first data voltage. The method also includes sensing a global current provided to the display panel, generating a current detection signal based on the sensed global current, and varying at least one of the first and second data voltages based on the current detection signal.

21 Claims, 23 Drawing Sheets

(56) References Cited

U.S. PATENT DOCUMENTS

| | | | | |
|---|---|---|---|---|
| 2007/0080905 | A1* | 4/2007 | Takahara | G09G 3/3233 345/76 |
| 2008/0203930 | A1* | 8/2008 | Budzelaar | G09G 3/3233 315/169.1 |
| 2012/0236041 | A1 | 9/2012 | Oh | |
| 2014/0354618 | A1 | 12/2014 | Shin | |

FOREIGN PATENT DOCUMENTS

| | | | |
|---|---|---|---|
| KR | 10-2005-0123325 | A | 12/2005 |
| KR | 10-2008-0057434 | A | 6/2008 |
| KR | 10-2014-0001708 | A | 1/2014 |
| KR | 10-2014-0054758 | A | 5/2014 |
| KR | 10-2014-0076696 | A | 6/2014 |

* cited by examiner

ELECTROLUMINESCENT DISPLAY FOR ADAPTIVE VOLTAGE CONTROL AND METHOD OF DRIVING ELECTROLUMINESCENT DISPLAY

INCORPORATION BY REFERENCE TO ANY PRIORITY APPLICATIONS

This application claims priority under 35 U.S.C. §119 to Korean Patent Application No. 10-2014-0182913 filed on Dec. 18, 2014, in the Korean Intellectual Property Office (KIPO), the disclosure of which is hereby incorporated by reference herein in its entirety.

BACKGROUND

Field

The described technology generally relates to an electroluminescent display for adaptive voltage control and a method of driving the electroluminescent display.

Description of the Related Technology

Various display devices such as liquid crystal displays (LCDs), plasma displays, and electroluminescent displays have gained popularity. Among these, electroluminescent displays have quick response speeds and reduced power consumption, using light-emitting diodes (LEDs) or organic light-emitting diodes (OLEDs) that emit light through recombination of electrons and holes.

The electroluminescent display can be driven with an analog or a digital driving method. While the analog driving method produces grayscale using variable voltage levels corresponding to input data, the digital driving method produces grayscale using variable time duration in which the LED emits light. The analog driving method is difficult to implement because it requires a driving integrated circuit (IC) that is complicated to manufacture if the display is large and has high resolution. The digital driving method, on the other hand, can readily accomplish the required high resolution through a simpler IC structure. As the size of the display panel becomes larger and the resolution increases, the digital driving method can have more favorable characteristics over the analog driving method.

SUMMARY OF CERTAIN INVENTIVE ASPECTS

Some inventive aspects are an electroluminescent display and a method of driving an electroluminescent display that can reduce power consumption and enhancing quality of displayed images through adaptive voltage control.

Another aspect is a method of driving an electroluminescent display that includes performing a digital driving of a display panel including a plurality of pixels based on a high power supply voltage, a low power supply voltage, a high data voltage and a low data voltage, generating a current detection signal by sensing a global current provided to the display panel and varying at least one of the high data voltage and the low data voltage based on the current detection signal.

The high data voltage can be varied such that a gate-source voltage of a driving transistor in each pixel for turning off the driving transistor is maintained uniformly.

The low data voltage can be varied such that a gate-source voltage of a driving transistor in each pixel for turning on the driving transistor is maintained uniformly.

The method can further include varying the high power supply voltage provided to the display panel based on input image data.

Varying at least one of the high data voltage and the low data voltage can include determining a supply voltage level of the high power supply voltage, calculating an ohmic drop of the high power supply voltage based on the current detection signal, calculating a local voltage level of the high power supply voltage by subtracting the ohmic drop from the supply voltage level, calculating a first target voltage level by subtracting a first voltage offset from the local voltage level and generating the high data voltage based on the first target voltage level.

Varying at least one of the high data voltage and the low data voltage can further include calculating a second target voltage level by subtracting a second voltage offset from the local voltage level, the second voltage offset being greater than the first voltage offset, and generating the low data voltage based on the second target voltage level.

Determining the supply voltage level of the high power supply voltage can include calculating an average grayscale value of the input image data and calculating the supply voltage level of the high power supply voltage provided to the display panel based on the average grayscale value.

Determining the supply voltage level of the high power supply voltage can include sensing the supply voltage level of the high power supply voltage provided to the display panel.

Determining the supply voltage level of the high power supply voltage can include calculating an average grayscale value of the input image data, calculating the supply voltage level of the high power supply voltage provided to the display panel based on the average grayscale value, sensing the supply voltage level of the high power supply voltage provided to the display panel and setting the supply voltage level to a greater voltage level of the calculated supply voltage level and the sensed supply voltage level.

The high data voltage and the low data voltage can be provided to a data driver included in the electroluminescent display, the data driver can generate data signals having voltage levels of the high data voltage or the low data voltage based on input image data, and each data signals can be applied to a gate electrode of a driving transistor in each pixel.

The high data voltage and the low data voltage can be provided to the display panel, a data driver included in the electroluminescent display can generate data signals having a logic high level or a logic low level based on input image data, and the high data voltage or the low data voltage can be applied to a gate electrode of a driving transistor in each pixel in response to each data signal.

The high power supply voltage can have a voltage level that is varied depending on input image data, and the low power supply voltage can have a voltage level that is fixed regardless of the input image data.

Generating the current detection signal can include sensing a red global current provided to red pixels among the pixels to generate a red current detection signal representing the red global current, sensing a green global current provided to green pixels among the pixels to generate a green current detection signal representing the green global current and sensing a blue global current provided to blue pixels among the pixels to generate a blue current detection signal representing the blue global current.

Varying at least one of the high data voltage and the low data voltage can include controlling a red high data voltage provided to the red pixels based on the red current detection signal, controlling a green high data voltage provided to the green pixels based on the green current detection signal and controlling a blue high data voltage provided to the blue pixels based on the blue current detection signal.

Varying at least one of the high data voltage and the low data voltage can further include controlling a red low data voltage provided to the red pixels based on the red current detection signal, controlling a green low data voltage provided to the green pixels based on the green current detection signal and controlling a blue low data voltage provided to the blue pixels based on the blue current detection signal.

Another aspect is an electroluminescent display that includes a display panel, a power supply unit, a current detection unit and a voltage controller. The display panel includes a plurality of pixels configured to perform a digital driving based on a high power supply voltage, a low power supply voltage, a high data voltage and a low data voltage. The power supply unit generates the high power supply voltage, the low power supply voltage, the high data voltage and the low data voltage based on an input voltage and a voltage control signal. The current detection unit senses a global current provided to the display panel to generate a current detection signal. The voltage controller generates the voltage control signal based on the current detection signal to vary at least one of the high data voltage and the low data voltage.

The voltage controller can include a first calculator configured to calculate an ohmic drop of the high power supply voltage based on the current detection signal, a second calculator configured to calculate a local voltage level of the high power supply voltage by subtracting the ohmic drop from a supply voltage level of the high power supply voltage, a third calculator configured to calculate a first target voltage level by subtracting a first voltage offset from the local voltage level, a fourth calculator configured to calculate a second target voltage level by subtracting a second voltage offset from the local voltage level where the second voltage offset is greater than the first voltage offset and a control signal generator configured to generate the voltage control signal based on the first target voltage level and the second target voltage level.

The voltage controller can further include a voltage calculator configured to calculate an average grayscale value of input image data and configured to calculate the supply voltage level of the high power supply voltage provided to the display panel based on the average grayscale value.

The electroluminescent display can further include a voltage detection unit configured to sense the supply voltage level of the high power supply voltage provided to the display panel to generate a voltage detection signal representing the sensed supply voltage level.

The voltage controller can generate the voltage control signal to vary the high data voltage such that a gate-source voltage of a driving transistor in each pixel for turning off the driving transistor is maintained uniformly and to vary the low data voltage such that the gate-source voltage for turning on the driving transistor is maintained uniformly.

The electroluminescent display and the associated driving method can reduce power consumption of the electroluminescent display and enhance quality of the displayed images by varying the high data voltage and/or the low data voltage so that the gate-source voltage for turning on or off the driving transistor can be maintained uniformly.

Another aspect is a method of driving an electroluminescent display, comprising digitally driving a display panel including a plurality of pixels based on a first power supply voltage, a second power supply voltage lower than the first power supply voltage, a first data voltage and a second data voltage lower than the first data voltage. The method also comprises sensing a global current provided to the display panel, generating a current detection signal based on the sensed global current, and varying at least one of the first and second data voltages based on the current detection signal.

In the above method, each of the pixels includes a driving transistor having a gate-source voltage configured to turn off the driving transistor, wherein the varying includes changing the first data voltage such that the gate-source voltage is maintained substantially uniformly.

In the above method, each of the pixels includes a driving transistor having a gate-source voltage configured to turn on the driving transistor, wherein the varying includes changing the second data voltage such that the gate-source voltage is maintained substantially uniformly.

The above method further comprises varying the first power supply voltage provided to the display panel based on input image data.

In the above method, varying the at least one of the first and second data voltages includes determining a supply voltage level of the first power supply voltage, calculating an ohmic drop of the first power supply voltage based on the current detection signal, subtracting the calculated ohmic drop from the supply voltage level so as to calculate a local voltage level of the first power supply voltage, subtracting a first voltage offset from the local voltage level so as to calculate a first target voltage level, and generating the first data voltage based on the first target voltage level.

In the above method, the varying further includes subtracting a second voltage offset from the local voltage level so as to calculate a second target voltage level, wherein the second voltage offset is greater than the first voltage offset, and generating the second data voltage based on the second target voltage level.

In the above method, the determining includes calculating an average grayscale value of the input image data and calculating the supply voltage level of the first power supply voltage provided to the display panel based on the average grayscale value.

In the above method, the determining includes sensing the supply voltage level of the first power supply voltage provided to the display panel.

In the above method, the determining includes calculating an average grayscale value of the input image data, calculating the supply voltage level of the first power supply voltage provided to the display panel based on the average grayscale value, sensing the supply voltage level of the first power supply voltage provided to the display panel, and setting the supply voltage level to one of the calculated supply voltage level and the sensed supply voltage level that has a greater level.

In the above method, the first and second data voltages are provided to a data driver included in the electroluminescent display, wherein the data driver is configured to generate a plurality of data signals having voltage levels of the first or second data voltage based on input image data, wherein each of the pixels has a driving transistor including a gate electrode, and wherein the data driver is further configured respectively apply each data signal to the gate electrode.

In the above method, the first and second data voltages are provided to the display panel, wherein the electroluminescent display includes a data driver configured to generate a plurality of data signals having a logic high level or a logic low level based on input image data, wherein each of the pixels has a driving transistor including a gate electrode, and wherein the data driver is further configured respectively apply the first or second data voltage to the gate electrode based on each data signal.

The above method further comprises varying a voltage level of the first power supply voltage based on input image data; and fixing a voltage level of the second power supply voltage have a voltage level regardless of the input image data.

In the above method, the pixels include red, green and blue pixels wherein the generating includes sensing a red global current provided to the red pixels so as to generate a red current detection signal representing the red global current, sensing a green global current provided to the green pixels so as to generate a green current detection signal representing the green global current, and sensing a blue global current provided to the blue pixels so as to generate a blue current detection signal representing the blue global current.

In the above method, the varying includes controlling a red first data voltage provided to the red pixels based on the red current detection signal, controlling a green first data voltage provided to the green pixels based on the green current detection signal, and controlling a blue first data voltage provided to the blue pixels based on the blue current detection signal.

In the above method, the varying further includes controlling a red second data voltage provided to the red pixels based on the red current detection signal, controlling a green second data voltage provided to the green pixels based on the green current detection signal, and controlling a blue second data voltage provided to the blue pixels based on the blue current detection signal.

Another aspect is an electroluminescent display comprising a display panel including a plurality of pixels configured to be driven digitally based on a first power supply voltage, a second power supply voltage lower than the first power supply voltage, a first data voltage and a second data voltage lower than the first data voltage. The display also comprises a power supply configured to generate the first and second power supply voltages and the first and second data voltages based on an input voltage and a voltage control signal, a current detector configured to sense a global current provided to the display panel to generate a current detection signal, and a voltage controller configured to generate the voltage control signal based on the current detection signal so as to vary at least one of the first and second data voltages.

In the above display, the voltage controller includes a first calculator configured to calculate an ohmic drop of the first power supply voltage based on the current detection signal, a second calculator configured to subtract the calculated ohmic drop from a supply voltage level of the first power supply voltage so as to calculate a local voltage level of the first power supply voltage, a third calculator configured to subtract a first voltage offset from the local voltage level so as to calculate a first target voltage level, a fourth calculator configured to subtract a second voltage offset from the local voltage level so as to calculate a second target voltage level, wherein the second voltage offset is greater than the first voltage offset, and a control signal generator configured to generate the voltage control signal based on the first and second target voltage levels.

In the above display, the voltage controller further includes a voltage calculator configured to calculate an average grayscale value of input image data and calculate the supply voltage level of the first power supply voltage provided to the display panel based on the average grayscale value.

The above display further comprises a voltage detector configured to sense the supply voltage level of the first power supply voltage provided to the display panel to generate a voltage detection signal representing the sensed supply voltage level.

In the above display, each of the pixels includes a driving transistor having a gate-source voltage, wherein the voltage controller is further configured to vary the first data voltage such that the gate-source voltage configured to turn off the driving transistor is maintained substantially uniformly and vary the second data voltage such that the gate-source voltage configured to turn on the driving transistor is maintained substantially uniformly.

DETAILED DESCRIPTION OF CERTAIN INVENTIVE EMBODIMENTS

Figure 1:
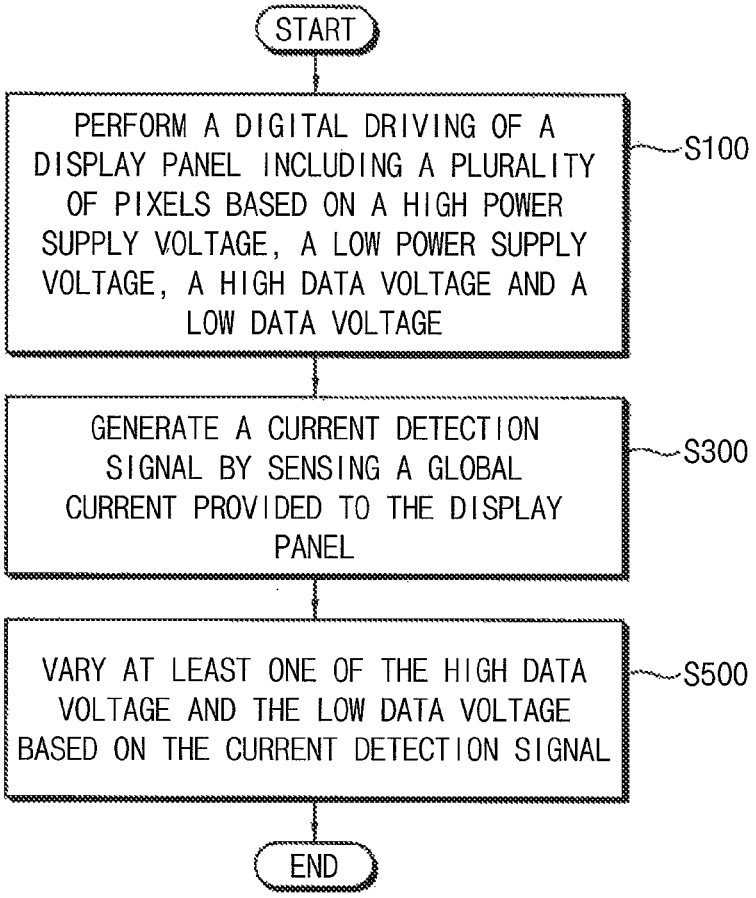
FIG. 1 is a flowchart illustrating a method of driving an electroluminescent display according to example embodiments.

For electroluminescent displays driven digitally, power consumption can increase and quality of the displayed image can degrade due to an ohmic drop or IR-drop of voltages, fluctuation of the temperature, characteristic deviation of the OLEDs, etc.

The example embodiments are described more fully hereinafter with reference to the accompanying drawings. Like or similar reference numerals refer to like or similar elements throughout. In this disclosure, the term "substantially" includes the meanings of completely, almost completely or to any significant degree under some applications and in accordance with those skilled in the art. Moreover, "formed on" can also mean "formed over." The term "connected" can include an electrical connection.

FIG. 1 is a flowchart illustrating a method of driving an electroluminescent display according to example embodiments.

In some embodiments, the FIG. 1 procedure is implemented in a conventional programming language, such as C or C++ or another suitable programming language. The program can be stored on a computer accessible storage medium of the electroluminescent display 10 (see FIG. 2), for example, a memory (not shown) of the electroluminescent display 10, voltage controller 20 (see FIG. 2) or timing controller 250 (see FIG. 15). In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 1. The description of this paragraph applies to the embodiments shown in FIG. 7.

Referring to FIG. 1, digitally driving display panel including a plurality of pixels is performed based on a high power supply voltage ELVDD, a low power supply voltage ELVSS, a high data voltage VDH and a low data voltage VDL (S100). The digital driving indicates a driving scheme that applies the data voltage of substantially the same level to the pixels and produces grayscale using variable time duration in which the LED emits light. For example, each frame is divided into a plurality of sub frames and each sub frame includes a scan period and an emission period. The emission periods in the respective sub frames can be time intervals of different lengths. Each pixel can store the corresponding data signal in the scan period and represent the grayscale by emitting or not emitting light depending on the stored data signal.

The high power supply voltage ELVDD can have a positive voltage level and the low power supply voltage ELVSS can have a negative voltage level or a ground voltage level. The high data voltage VIM can have a positive voltage level and the low data voltage VDL can have a voltage level less than the high data voltage VDH. The low data voltage can have a positive voltage level, a ground voltage level or a negative voltage level.

A current detection signal CDET is generated by sensing a global current GI provided to the display panel (S300). The global current GI can correspond to the sum of the driving currents respectively flowing through the pixels. In some embodiments, the global current corresponds to the sum of the driving current of all the pixels in the display panel. In other embodiments, the global current corresponds to the sum of the driving currents of a portion of all the pixels, e.g., red pixels, green pixels or blue pixels in the display panel.

At least one of the high data voltage VDH and the low data voltage VDL is varied based on the current detection signal CDET (S500). In some embodiments, only the high data voltage VDH is varied based on the current detection signal CDET and the low data voltage VDL is maintained at a fixed voltage level regardless of the current detection signal CDET. In other embodiments, both of the high data voltage VDH and the low data voltage VDL can be varied based on the current detection signal CDET. In this case, the difference between the high data voltage VDH and the low data voltage VDL can be maintained substantially uniformly regardless of the current detection signal CDET.

As will be described below, the high data voltage VDH can be varied based on the current detection signal CDET so that a gate-source voltage of a driving transistor in each pixel for turning off the driving transistor can be maintained uniformly. In addition, the low data voltage VDL can be varied based on the current detection signal CDET so that the gate-source voltage for turning on the driving transistor can be maintained substantially uniformly.

As such, the method of driving the electroluminescent display according to example embodiments reduces power consumption of the electroluminescent display and enhances quality of the displayed images by varying the high data voltage VDH and/or the low data voltage VDL so that the gate-source voltage for turning on or off the driving transistor can be maintained substantially uniformly.

Figure 2:
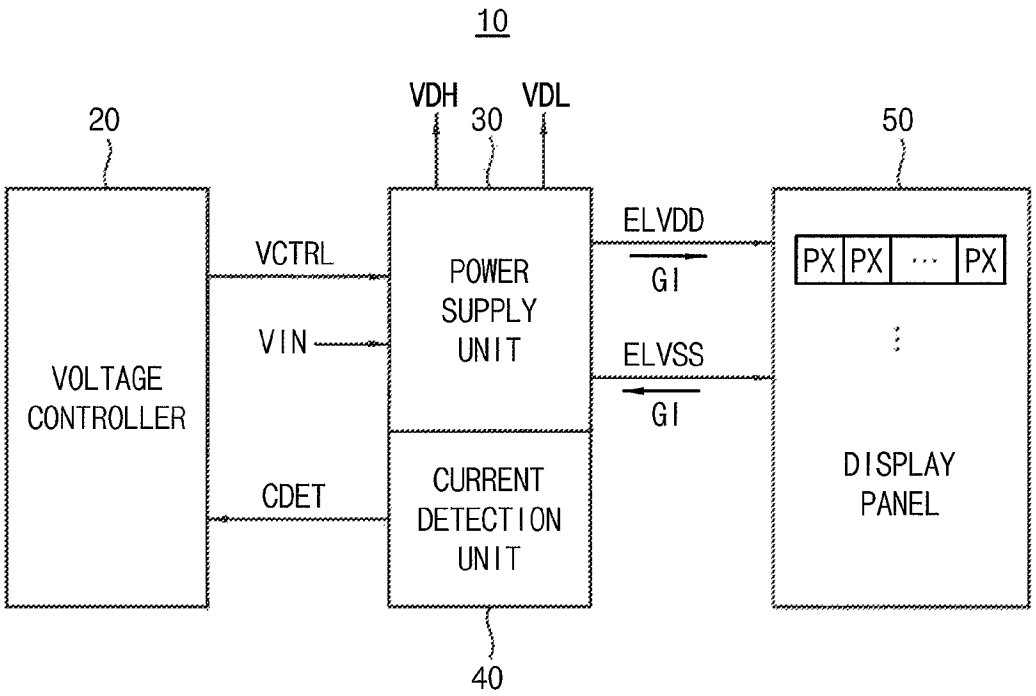
FIG. 2 is a block diagram illustrating an electroluminescent display according to example embodiments.

FIG. 2 is a block diagram illustrating an electroluminescent display according to example embodiments, Referring to FIG. 2, an electroluminescent display 10 includes a voltage controller 20, a power supply unit or power supply 30, a current detection unit or current detector 40 and a display panel 50. The current detection unit 40 can be included in the power supply unit 30 or be external to the power supply unit 30.

The display panel 50 includes a plurality of pixels PX performing a digital driving based on a high power supply voltage ELVDD, a low power supply voltage ELVSS, a high data voltage VDH and a low data voltage VDL. The display panel 50 and the pixel PX are further described with reference to FIGS. 3 and 15 through 21.

The digital driving indicates a driving scheme that applies the data voltage of substantially the same level to the pixels and produces grayscale using variable time duration in which the LED emits light. For example, each frame is divided into a plurality of sub frames and each sub frame includes a scan period and an emission period. The emission periods in the respective sub frames can be time intervals of different lengths. Each pixel can store the corresponding data signal in the scan period and represent the grayscale by emitting or not emitting light depending on the stored data signal.

The power supply unit 30 generates the high power supply voltage ELVDD, the low power supply voltage ELVSS, the high data voltage VDH and the low data voltage VDL based on an input voltage VIN and a voltage control signal VCTRL. The power supply unit 30 can include a boost converter generating a high positive voltage, an inverting buck-boost converter generating a negative voltage, etc. The input voltage VIN provided to the power supply unit 30 can be an AC voltage or a DC voltage from a battery, and the voltage converters in the power supply unit 30 can be an AC-DC converter or a DC-DC converter. As illustrated in FIG. 2, the high power supply voltage ELVDD and the low power supply voltage ELVSS are provided to the display panel 50. In some embodiments, the high data voltage VDH and the low data voltage VDL are provided to a data driver as described below with reference to FIGS. 15 and 16. In other embodiments, the high data voltage VDH and the low data voltage VDL are provided to the display panel as described below with reference to FIGS. 17 and 18.

The current detection unit 40 senses a global current GI provided to the display panel 50 and generates a current detection signal CDET. The global current GI can correspond to the sum of the driving currents respectively flowing through the pixels. In some embodiments, the global current corresponds to the sum of the driving current of all the pixels in the display panel. In other embodiments, the global current corresponds to the sum of the driving currents of a portion of all the pixels, e.g., red pixels, green pixels or blue pixels in the display panel. The operations of the current detection unit 40 are further described with reference to FIGS. 12 and 14.

The voltage controller 20 generates a voltage control signal VCTRL, such that at least one of the high data voltage VDH and the low data voltage VDL can be varied based on the current detection signal CDET provided from the current detection unit 40, and provides the voltage control signal VCTRL to the power supply unit 30. The voltage controller 20 can adjust the voltage control signal VCTRL to control the voltage levels of the high power supply voltage ELVDD, the low power supply voltage ELVSS, the high data voltage VDH and/or the low data voltage VDL generated by the power supply unit 30, respectively. The voltage control signal VCTRL can include a plurality of control signals for respectively controlling the high power supply voltage ELVDD, the low power supply voltage ELVSS, the high data voltage VDH and/or the low data voltage VDL.

In some embodiments, only the high data voltage VDH is varied based on the current detection signal CDET and the low data voltage VDL is maintained at a fixed voltage level regardless of the current detection signal CDET. In other embodiments, both of the high data voltage VDH and the low data voltage VDL are varied based on the current detection signal CDET. In this case, the difference between the high data voltage VDH and the low data voltage VDL can be maintained substantially uniformly regardless of the current detection signal CDET.

As will be described below, the electroluminescent display 10 can vary the high data voltage VDH based on the current detection signal CDET so that a gate-source voltage of a driving transistor in each pixel for turning off the driving transistor can be maintained substantially uniformly. In addition, the electroluminescent display 10 can vary the low data voltage VDL based on the current detection signal CDET so that the gate-source voltage for turning on the driving transistor can be maintained substantially uniformly.

As such, the electroluminescent display 10 reduces power consumption of the electroluminescent display 10 and enhances quality of the displayed images by varying the high data voltage VDH and/or the low data voltage VDL so that the gate-source voltage for turning on or off the driving transistor can be maintained substantially uniformly.

Figure 3:
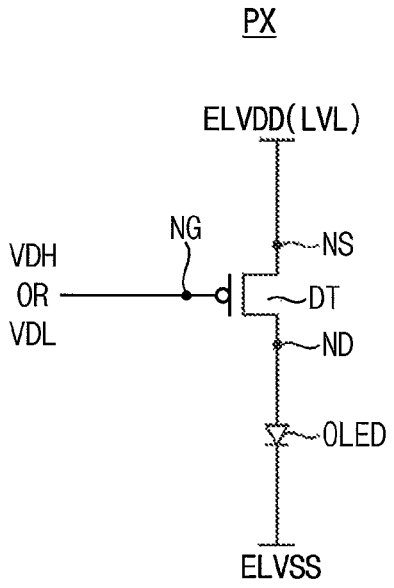
FIG. 3 is a circuit diagram illustrating a basic structure of a pixel included in the electroluminescent display of FIG. 2.

FIG. 3 is a circuit diagram illustrating a basic structure of a pixel PX included in the electroluminescent display of FIG. 2.

Figure 16:
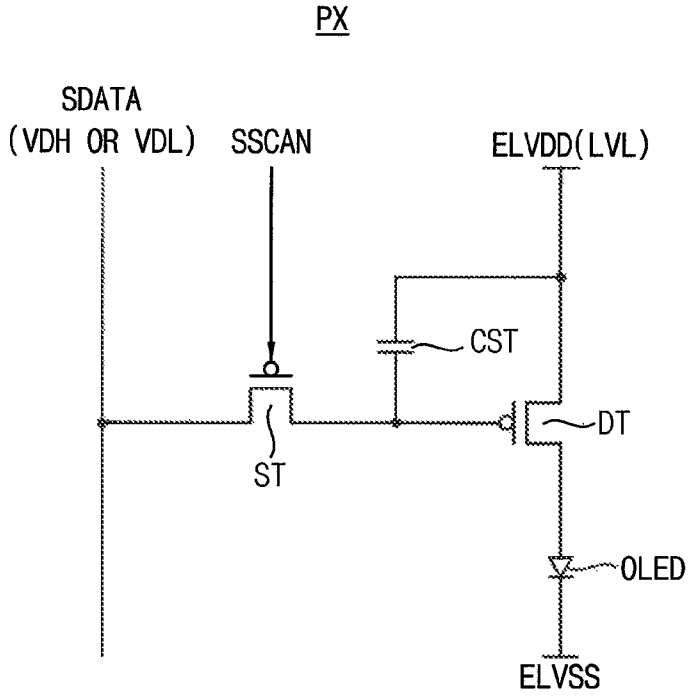
FIG. 16 is a circuit diagram illustrating an example of a pixel included in the electroluminescent display of FIG. 15.
Figure 18:
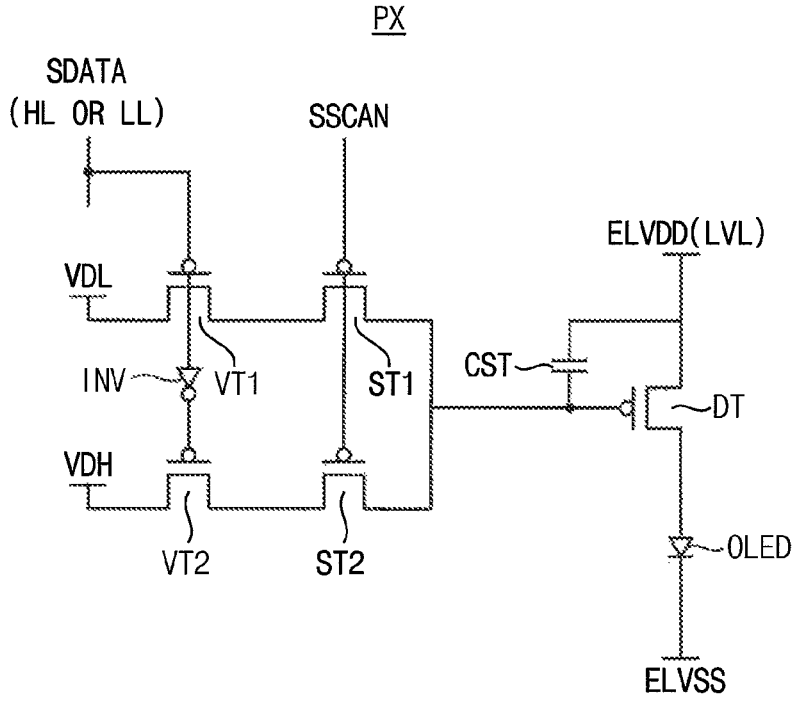
FIG. 18 is a circuit diagram illustrating an example of a pixel included in the electroluminescent display of FIG. 17.
Figure 21:
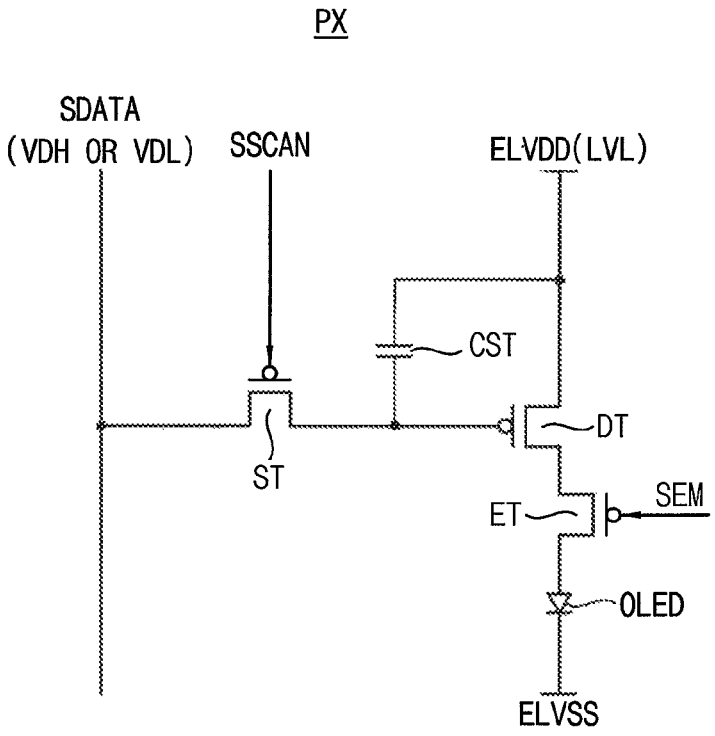
FIG. 21 is a circuit diagram illustrating an example of a pixel included in the electroluminescent display of FIG. 20.

As illustrated in FIGS. 16, 18 and 21, the pixel PX can be configured variously to include the basic structure of FIG. 3.

Referring to FIG. 3, the pixel PX includes a driving transistor DT and an OLED connected in series between the high power supply voltage ELVDD and the low power supply voltage ELVSS. The source electrode NS of the driving transistor DT is connected to the high power supply voltage ELVDD and the drain electrode ND of the driving transistor DT is connected to the diode OLED. As illustrated in FIG. 3, the driving transistor DT is implemented with a p-channel metal-oxide-semiconductor (PMOS) transistor. In this case, the driving transistor DT can be turned off when the high data voltage VDH of the relatively higher voltage level is applied to the gate electrode NG and the driving transistor DT can be turned on when the low data voltage VDL of the relatively lower voltage level is applied to the gate electrode NG.

The high power supply voltage ELVDD applied to the driving transistor DT has a local voltage level LVL. Due to the parasitic resistance component on the power supply paths, the local voltage level LVL of the high power supply voltage ELVDD at the local pixel is less than a supply voltage level SVL of the high power supply voltage ELVDD provided to the display panel. According to example embodiments, the high data voltage VDH and/or the low data voltage VDL are varied by reflecting the change of the high power supply voltage ELVDD, thereby reducing power consumption and enhancing quality of the displayed images.

Figure 4:
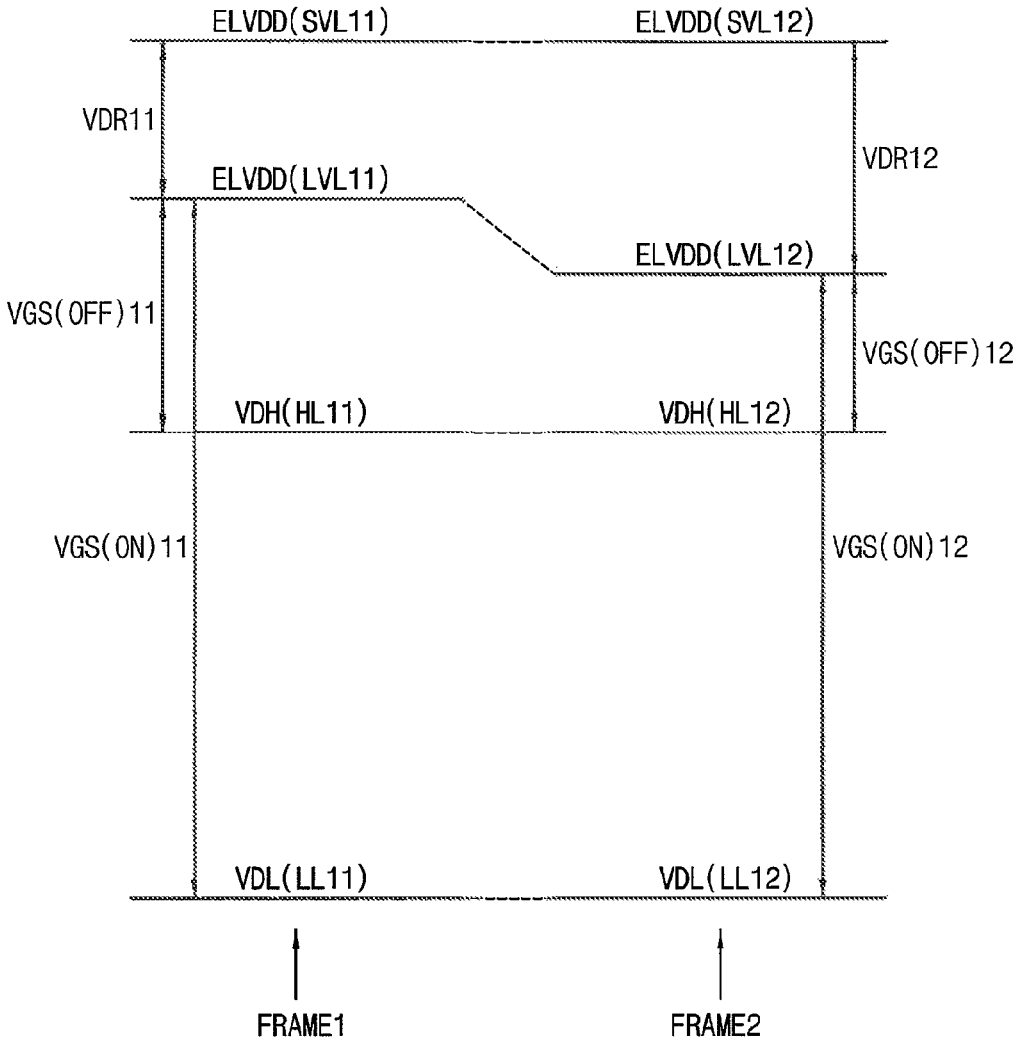
FIGS. 4, 5 and 6 are conceptual diagrams for describing adaptive voltage control according to example embodiments.
Figure 5:
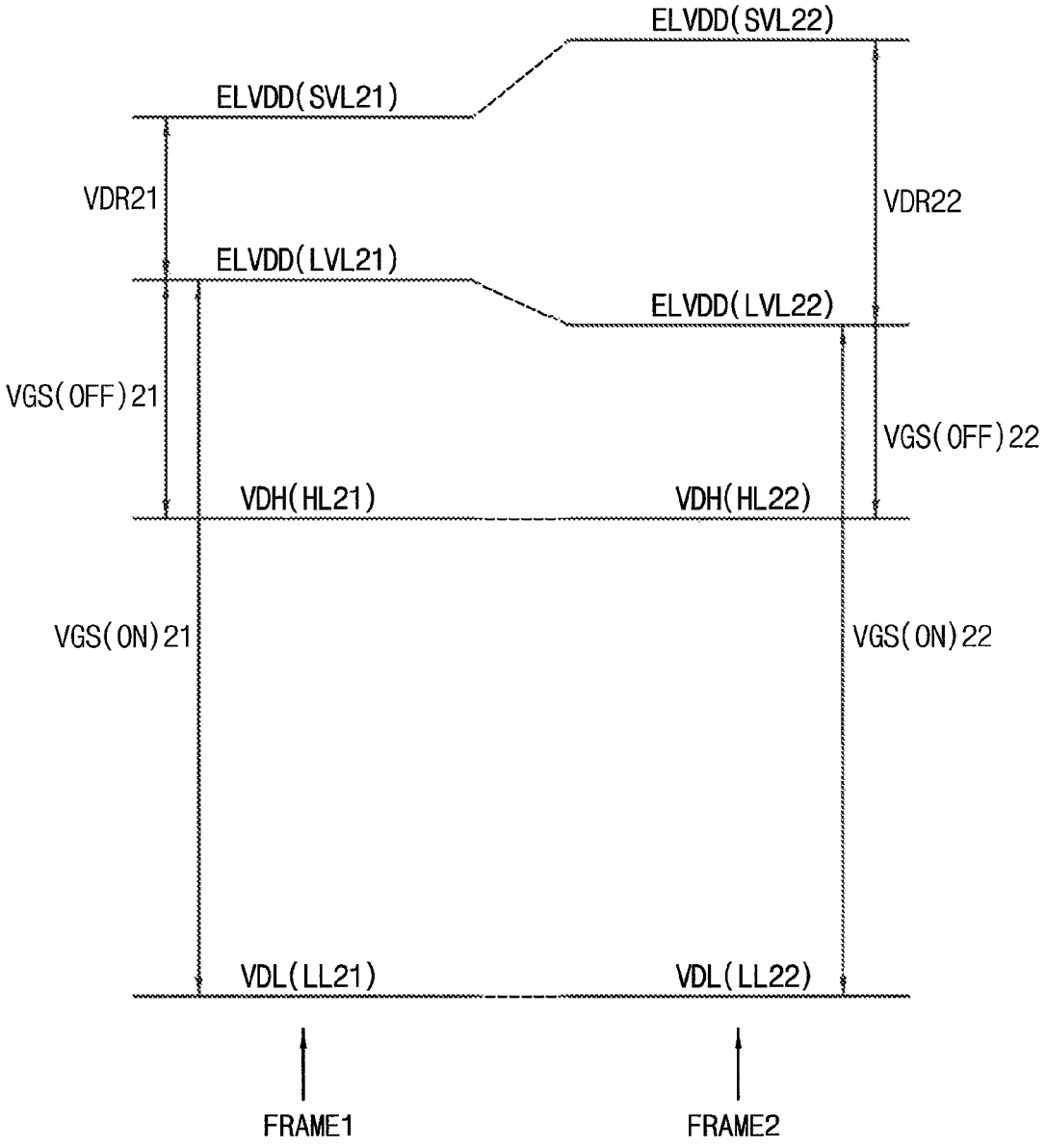
Figure 6:
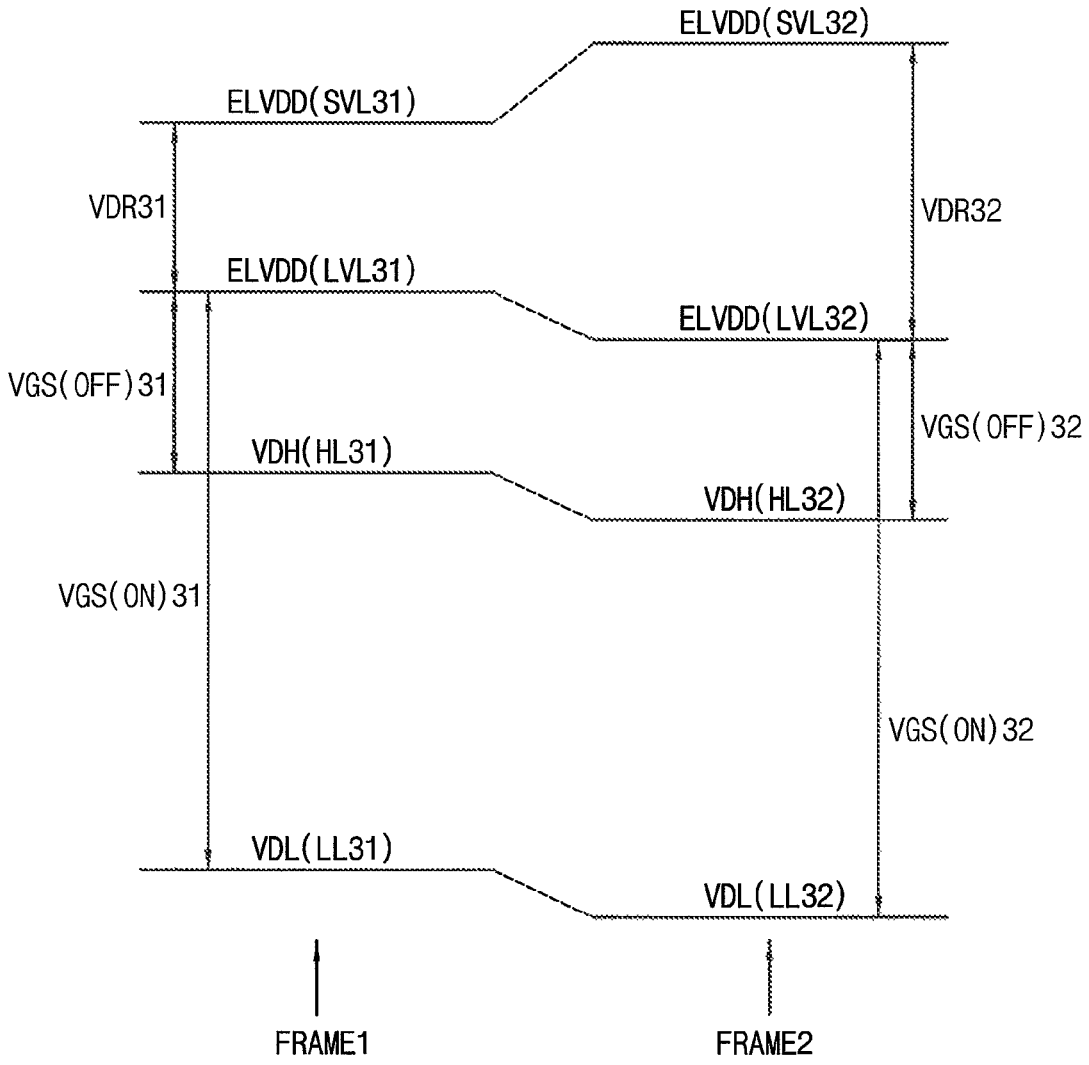

FIGS. 4, 5 and 6 are conceptual diagrams for describing adaptive voltage control according to example embodiments.

FIGS. 4, 5 and 6 illustrate examples that the input image data of the relatively higher brightness is displayed in the first frame period FRAME1 and the input image data of the relatively lower brightness is displayed in a second frame period FRAME2. FIGS. 4 and 5 illustrate the relations between the voltages when the high data voltage VDH and the low data voltage VDL are fixed. FIG. 6 illustrates the relations between the voltages when the high data voltage VDH and the low data voltage VDL are varied adaptively according to example embodiments.

Referring to FIG. 4, the supply voltage level SVL of the high power supply voltage ELVDD provided to the display panel is fixed regardless of the brightness or the grayscale values of the input image data. For example, the supply voltage level SVL21 in the second frame period FRAME2 substantially equal to the supply voltage level SVL11 in the first frame period FRAME1.

The local voltage level LVL of the high power supply voltage ELVDD at the local pixels can be varied depending on the brightness of the input image data because the ohmic drop or the IR drop increases as the brightness of the input image data increases. For example, the ohmic drop VDR12 in the second frame period FRAME2 is greater than the ohmic drop VDR11 in the first frame period FRAME1 and thus the local voltage level LVL12 in the second frame period FRAME2 is less than the local voltage level LVL11 in the first frame period FRAME1.

As described with reference to FIG. 2, the high power supply voltage ELVDD of the local voltage level LVL is applied to the source electrode NS of the driving transistor DT. When the high data voltage VDH is applied to the gate electrode NG of the driving transistor DT, the driving transistor DT is turned off and the gate-source voltage VGS(OFF) for turning off the driving transistor DT corresponds to the difference between the local voltage level LVL and the high data voltage VDH. In contrast, when the low data voltage VDL is applied to the gate electrode NG of the driving transistor DT, the driving transistor DT is turned on and the gate-source voltage VGS(ON) for turning on the driving transistor DT corresponds to a difference between the local voltage level LVL and the low data voltage VDL.

As illustrated in FIG. 4, the high data voltage VDH and the low data voltage VDL are maintained at fixed voltage levels, respectively. For example, the voltage levels HL11 and LL11 of the high data voltage VDH and the low data voltage VDL in the first frame period FRAME1 are substantially equal to the voltage levels HL12 and LL12 of the high data voltage VDH and the low data voltage VDL in the second frame period FRAME2, respectively. In this case, the gate-source voltages VGS(OFF)11 and VGS(ON)11 in the first frame period FRAME1 are different from the gate source-voltages VGS(OFF)12 and VGS(ON)12 in the second frame period FRAME2 depending on the brightness of the input image data.

Referring to FIG. 5, the supply voltage level SVL of the high power supply voltage ELVDD provided to the display panel is varied depending on the brightness or the grayscale values of the input image data. For example, the supply voltage level SVL22 in the second frame period FRAME2 is greater than the supply voltage level SVL21 in the first frame period FRAME1.

The local voltage level LVL of the high power supply voltage ELVDD at the local pixels can be varied depending on the brightness of the input image data because the ohmic drop or the IR drop increases as the brightness of the input image data increases. For example, the ohmic drop VDR22 in the second frame period FRAME2 can be greater than the ohmic drop VDR21 in the first frame period FRAME1 and thus the local voltage level LVL22 in the second frame period FRAME2 can be lower than the local voltage level LVL21 in the first frame period FRAME1 as illustrated in FIG. 5. If the supply voltage level SLV22 in the second frame period FRAME2 is set to be higher than the level as illustrated in FIG. 5, the local voltage level LVL22 in the second frame period FRAME2 can be higher than the local voltage level LVL21 in the first frame period FRAME1.

As illustrated in FIG. 5, the high data voltage VDH and the low data voltage VDL can be maintained at fixed voltage levels, respectively. For example, the voltage levels HL21 and LL21 of the high data voltage VDH and the low data voltage VDL in the first frame period FRAME1 are substantially equal to the voltage levels HL22 and LL22 of the high data voltage VDH and the low data voltage VDL in the second frame period FRAME2, respectively. In this case, the gate source-voltages VGS(OFF)21 and VGS(ON)21 in the first frame period FRAME1 are different from the gate source-voltages VGS(OFF)22 and VGS(ON)22 in the second frame period FRAME2 depending on the brightness of the input image data.

When the high data voltage VDH and the low data voltage VDL are maintained at the fixed voltage levels as illustrated in FIGS. 4 and 5, the high data voltage VDH and the low data voltage VDL have to be set with sufficient margins to secure the switching operations (that is, turn-on and turn-off) of the driving transistor DT. The high data voltage VDH has to be set to a level higher than necessary to secure the turn-off of the driving transistor DT in the worst case and the low data voltage VDL has to be set to a level lower than necessary to secure the turn-on of the driving transistor DT in the worst case.

As a result, the difference between the high data voltage VDH and the low data voltage VDL has to be set to the sufficiently greater value, thereby increasing the switching loss of the driving transistor DT. The switching operations become more frequent in the digital driving where that driving transistor DT can be turned on or off per sub frame, and thus the switching loss increases significantly as the difference between the high data voltage VDH and the low data voltage VDL increases.

Referring to FIG. 6, the supply voltage level SVL of the high power supply voltage ELVDD provided to the display panel is varied depending on the brightness or the grayscale values of the input image data. For example, the supply voltage level SVL32 in the second frame period FRAME2 is greater than the supply voltage level SVL31 in the first frame period FRAME1.

The local voltage level LVL of the high power supply voltage ELVDD at the local pixels can be varied depending on the brightness of the input image data because the ohmic drop or the IR drop increases as the brightness of the input image data increases. For example, the ohmic drop VDR32 in the second frame period FRAME2 is greater than the ohmic drop VDR31 in the first frame period FRAME1 and thus the local voltage level LVL32 in the second frame period FRAME2 is less than the local voltage level LVL31 in the first frame period FRAME1 as illustrated in FIG. 6. If the supply voltage level SLV32 in the second frame period FRAME2 is set to be greater than the level as illustrated in FIG. 6, the local voltage level LVL32 in the second frame period FRAME2 can be greater than the local voltage level LVL31 in the first frame period FRAME1.

As illustrated in FIG. 6, the high data voltage VDH and the low data voltage VDL are varied based on above-mentioned current detection signal CDET. For example, the voltage levels HL32 and LL32 of the high data voltage VDH and the low data voltage VDL in the second frame period FRAME2 are less than the voltage levels HL31 and LL31 of the high data voltage VDH and the low data voltage VDL in the first frame period FRAME1, respectively. In this case, the gate source-voltages VGS(OFF)31 and VGS(ON)31 in the first frame period FRAME1 are substantially the same as the gate source-voltages VGS(OFF)32 and VGS(ON)32 in the second frame period FRAME2 regardless of the brightness of the input image data.

As such, the gate-source voltage VGS(ON) for turning on the driving transistor DT and the gate-source voltage VGS (OFF) for turning off the driving transistor DT can be maintained substantially uniformly, respectively. In this case, the margin for the worst case need not be considered and the difference between the high data voltage VDH and the low data voltage VDL can be set to a value less than the cases of FIGS. 4 and 5. As a result, the switching loss can be reduced by decreasing the difference between the high data voltage VDH and the low data voltage VDL.

Figure 7:
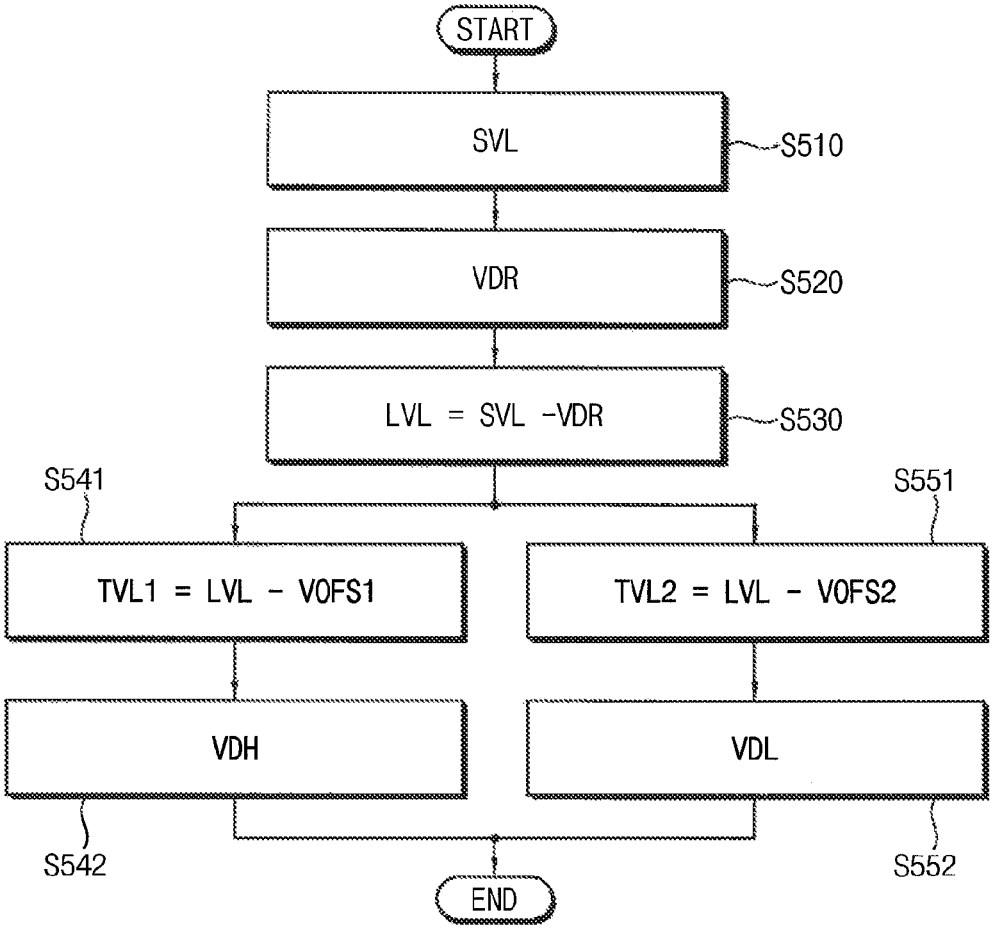
FIG. 7 is a diagram illustrating a process of varying a data voltage according to an example embodiment.
Figure 8:
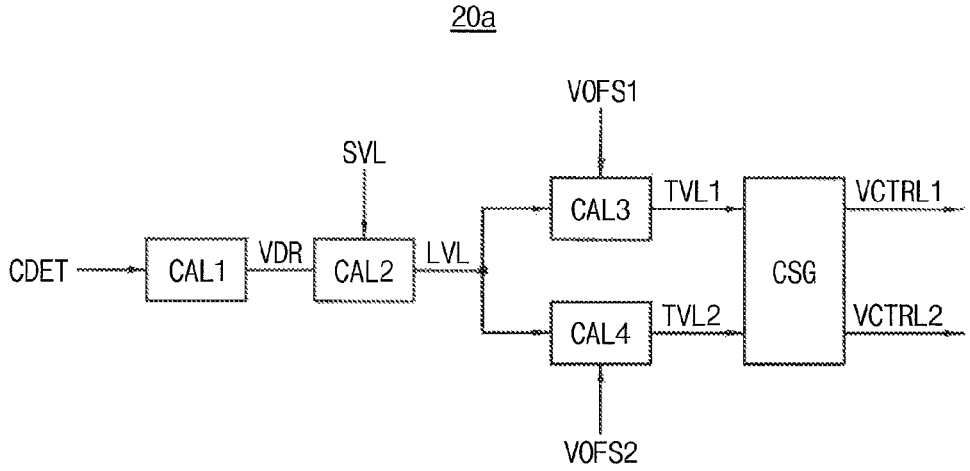
FIG. 8 is a block diagram illustrating an example embodiment of a voltage controller included in the electroluminescent display of FIG. 2.

FIG. 7 is a diagram illustrating a process of varying a data voltage according to an example embodiment. FIG. 8 is a block diagram illustrating an example embodiment of a voltage controller included in the electroluminescent display of FIG. 2.

Referring to FIGS. 7 and 8, a voltage controller 20*a* includes a first calculator CAL1, a second calculator CAL2, a third calculator CAL3, a fourth calculator CAL4 and a control signal generator CSG.

A supply voltage level SVL of the high power supply voltage ELVSS can be determined (S510). In some embodiments, the supply voltage level of the high power supply voltage ELVDD provided to the display panel is sensed and the sensed supply voltage level SVLS is determined as the supply voltage level SVL of the high power supply voltage ELVDD. In other embodiments, the supply voltage level of the high power supply voltage ELVDD provided to the display panel is calculated based on the input image data and the calculated supply voltage level SVLC is determined as the supply voltage level SVL of the high power supply voltage ELVDD. In still other embodiments, the sensed supply voltage level SVLS and the calculated supply voltage level SVLC are compared and the supply voltage level SVL is set to a greater voltage level of the sensed supply voltage level SVLS and the calculated supply voltage level SVLC.

The first calculator CAL1 can calculate an ohmic drop VDR of the high power supply voltage ELVSS based on the current detection signal CDET (S520). As described above, the current detection signal CDET can represent the global current GI. The product GI*Rp of the global current GI and the resistance value Rp on the path for supplying the high power supply voltage ELVDD can be calculated as the ohmic drop VDR. The path and the resistance value Rp can be determined based on a predetermined standard or criterion. For example, the path is determined from a first point near the power supply unit 30 in FIG. 2 to a second point where the global current GI is divided into a plurality of cell driving currents, and the parasitic resistance between the first point and the second point is set to the resistance value Rp for the calculation of the ohmic drop VDR. In an example configuration, the high power supply voltage ELVDD is applied to a center portion of the display panel 50 and the cell driving currents is branched sequentially going from the center portion to edge portions. In this case, the parasitic resistance from the power supply unit 30 to the center portion of the display panel 50 can be determined as the resistance value Rp for the calculation of the ohmic drop VDR.

The second calculator CAL2 can calculate a local voltage level LVL of the high power supply voltage ELVDD by subtracting the ohmic drop VDR from the supply voltage level SVL of the high power supply voltage ELVDD (S530).

The third calculator CAL3 can calculate a first target voltage level TVL1 by subtracting a first voltage offset VOFS1 from the local voltage level LVL (S541). The fourth calculator CAL4 can calculate a second target voltage level TVL2 by subtracting a second voltage offset VOFS2 from the local voltage level LVL (S551), where the second voltage offset VOFS2 is greater than the first voltage offset VOFS1. Referring back to FIG. 6, the first voltage offset VOFS1 can correspond to the gate-source voltage VGS (OFF) for turning off the driving transistor DT and the second voltage offset VOFS2 can correspond to the gate-source voltage VGS(ON) for turning on the driving transistor DT.

The control signal generator CSG can generate a first voltage control signal VCTRL1 and a second voltage control signal VCTRL2 based on the first target voltage level TVL1 and the second target voltage level TVL2, respectively. The first voltage control signal VCTRL1 and the second voltage control signal VCTRL2 can be included in the voltage control signal VCTRL illustrated in FIG. 2. The power supply unit 30 in FIG. 2 can generate the high data voltage VDH based on the first voltage control signal VCTRL1 (S542), and generate the low data voltage VDL based on the second voltage control signal VCTRL2 (S552).

FIG. 8 illustrates the elements for generating the first and second voltage control signals VCTRL1 and VCTRL2 to control the high data voltage VDH and the low data voltage VDL. Even though not illustrated in FIG. 8, the voltage controller 20*a* can further include elements for generating control signals to control the high power supply voltage ELVDD and/or the low power supply voltage ELVSS.

As such, power consumption of the electroluminescent display can be reduced and quality of the displayed images can be enhanced by varying the high data voltage VDH and/or the low data voltage VDL so that the gate-source voltage for turning on or off the driving transistor DT can be maintained substantially uniformly.

Figure 9:
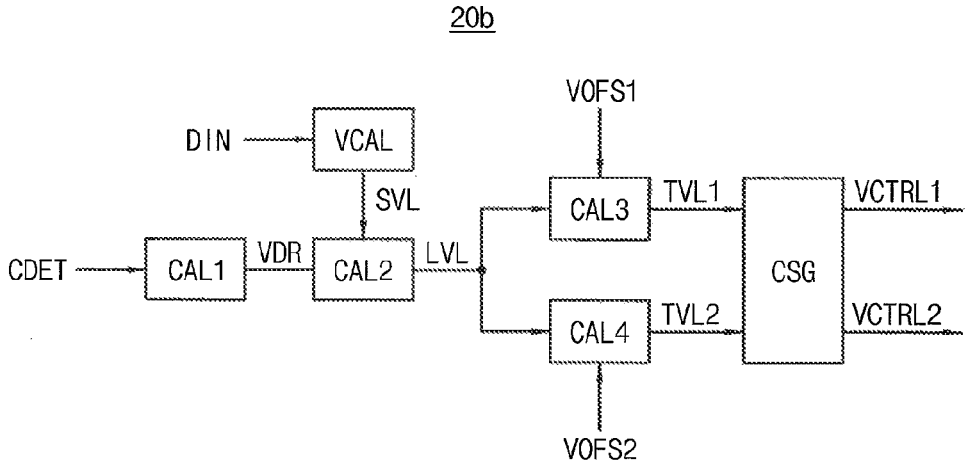
FIG. 9 is a block diagram illustrating another example embodiment of the voltage controller included in the electroluminescent display of FIG. 2.

FIG. 9 is a block diagram illustrating another example embodiment of a voltage controller included in the electroluminescent display of FIG. 2.

Referring to FIGS. 7 and 9, a voltage controller 20*b* can include a voltage calculator VCAL, a first calculator CAL1, a second calculator CRL2, a third calculator CAL3, a fourth calculator CAL4 and a control signal generator CSG. In comparison with the voltage controller 20*a* of FIG. 8, the voltage controller 20*b* of FIG. 9 further includes the voltage calculator VCAL. The other elements are substantially the same and repeated descriptions are omitted.

The voltage calculator VCAL can calculate an average grayscale value of input image data DIN and calculate the supply voltage level SVL of the high power supply voltage ELVDD based on the average grayscale value. The supply voltage level SVL calculated by the voltage calculator VCAL can be determined as the supply voltage level SVL of the high power supply voltage ELVDD provided to the display panel (S510).

The first calculator CAL1 can calculate an ohmic drop VDR of the high power supply voltage ELVSS based on the current detection signal CDET (S520). The second calculator CAL2 can calculate a local voltage level LVL of the high power supply voltage ELVDD by subtracting the ohmic drop VDR from the supply voltage level SVL of the high power supply voltage ELVDD (S530). The third calculator CAL3 can calculate a first target voltage level TVL1 by subtracting a first voltage offset VOFS1 from the local voltage level LVL (S541). The fourth calculator CAL4 can calculate a second target voltage level TVL2 by subtracting a second voltage offset VOFS2 from the local voltage level LVL (S551), where the second voltage offset VOFS2 is greater than the first voltage offset VOFS1. The control signal generator CSG can generate a first voltage control signal VCTRL1 and a second voltage control signal VCTRL2 based on the first target voltage level TVL1 and the second target voltage level TVL2, respectively. The power supply unit 30 in FIG. 2 can generate the high data voltage VDH based on the first voltage control signal VCTRL1 (S542), and generate the low data voltage VDL based on the second voltage control signal VCTRL2 (S552).

Figure 10:
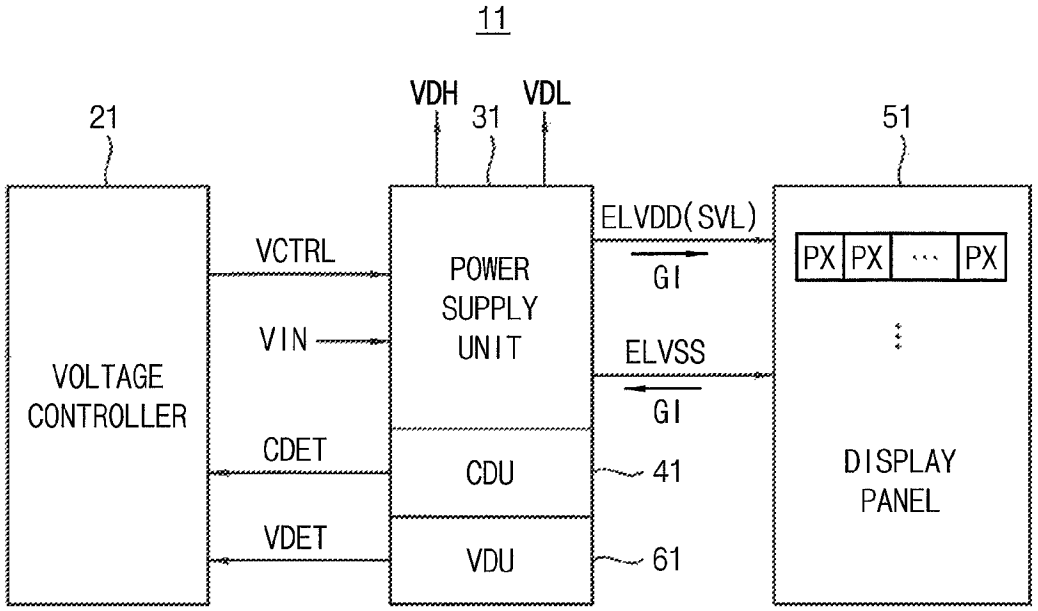
FIG. 10 is a block diagram illustrating an electroluminescent display according to example embodiments.

FIG. 10 is a block diagram illustrating an electroluminescent display according to example embodiments.

Referring to FIG. 10, an electroluminescent display 11 includes a voltage controller 21, a power supply unit or power supply 31, a current detection unit or current detector 41, a voltage detection unit or voltage detector 61 and a display panel 50. The current detection unit 41 and/or the voltage detection unit 61 can be included in the power supply unit 31 or formed exterior to the power supply unit 31.

In comparison with the electroluminescent display 10 of FIG. 2, the electroluminescent display 11 of FIG. 10 further includes the voltage detection unit 61. The other elements are substantially the same and repeated descriptions are omitted.

The display panel 51 includes a plurality of pixels PX performing a digital driving based on a high power supply voltage ELVDD, a low power supply voltage ELVSS, a high data voltage VDH and a low data voltage VDL.

The power supply unit 31 generates the high power supply voltage ELVDD, the low power supply voltage ELVSS, the high data voltage VDH and the low data voltage VDL based on an input voltage VIN and a voltage control signal VCTRL. As illustrated in FIG. 10, the high power supply voltage ELVDD and the low power supply voltage ELVSS can be provided to the display panel 51. In some embodiments, the high data voltage VDH and the low data voltage VDL are provided to a data driver as described below with reference to FIGS. 15 and 16. In other embodiments, the high data voltage VDH and the low data voltage VDL are provided to the display panel as described below with reference to FIGS. 17 and 18.

The current detection unit 41 senses a global current GI provided to the display panel 50 and generates a current detection signal CDET. The global current GI can correspond to the sum of the driving currents respectively flowing through the pixels. In some embodiments, the global current corresponds to the sum of the driving current of all the pixels in the display panel. In other embodiments, the global current corresponds to the sum of the driving currents of a portion of all the pixels, e.g., red pixels, green pixels or blue pixels in the display panel. The operations of the current detection unit 41 are further described with reference to FIGS. 12 and 14.

The voltage detection unit 61 senses the supply voltage level SVL of the high power supply voltage ELVDD provided to the display panel 51 to generate a voltage detection signal VDET representing the sensed supply voltage level SVL. The supply voltage level SVL corresponds to a voltage level of the high power supply voltage ELVDD output from the power supply unit 31 before the above-described ohmic drop occurs. The operations of the voltage detection unit 61 are further described with reference to FIG. 12.

The voltage controller 21 generates a voltage control signal VCTRL, such that at least one of the high data voltage VDH and the low data voltage VDL can be varied based on the current detection signal CDET and the voltage detection signal VDET, and provides the voltage control signal VCTRL to the power supply unit 31. The voltage controller 21 can adjust the voltage control signal VCTRL to control the voltage levels of the high power supply voltage ELVDD, the low power supply voltage ELVSS, the high data voltage VDH and/or the low data voltage VDL generated by the power supply unit 30, respectively. The voltage control signal VCTRL can include a plurality of control signals for respectively controlling the high power supply voltage ELVDD, the low power supply voltage ELVSS, the high data voltage VDH and/or the low data voltage VDL.

As described above, the electroluminescent display 11 can vary the high data voltage VDH based on the current detection signal CDET and the voltage detection signal VDET so that the gate-source voltage of the driving transistor in each pixel for turning off the driving transistor can be maintained substantially uniformly. In addition, the electroluminescent display 11 can vary the low data voltage VDL based on the current detection signal CDET and the voltage detection signal VDET so that the gate-source voltage for turning on the driving transistor can be maintained substantially uniformly.

As such, the electroluminescent display 11 according to example embodiments reduces power consumption of the electroluminescent display 11 and enhances quality of the displayed images by varying the high data voltage VDH and/or the low data voltage VDL so that the gate-source voltage for turning on or off the driving transistor can be maintained substantially uniformly.

Figure 11:
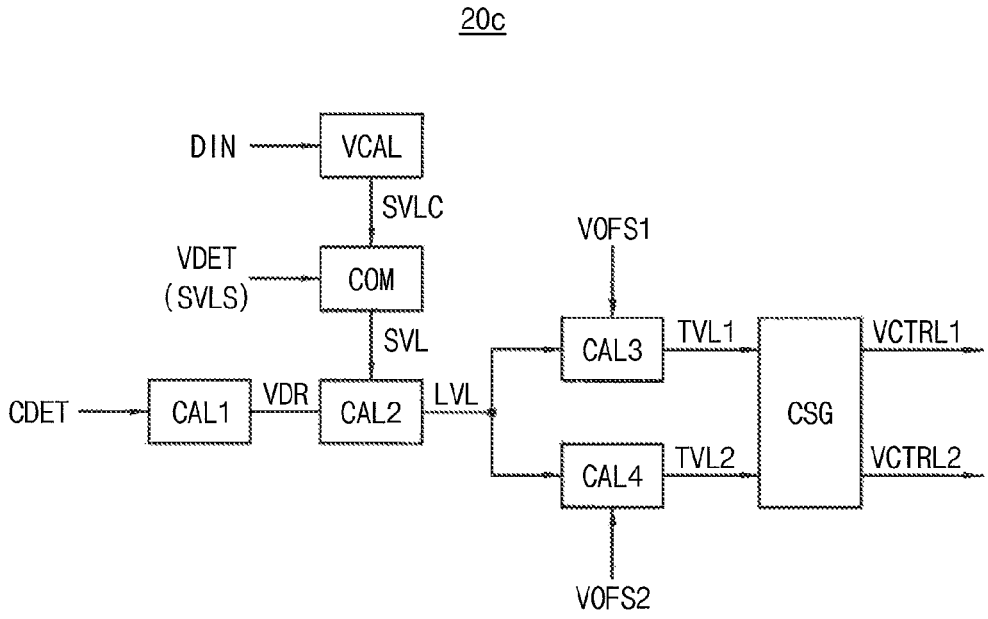
FIG. 11 is a block diagram illustrating an example embodiment of a voltage controller included in the electroluminescent display of FIG. 10.

FIG. 11 is a block diagram illustrating an example embodiment of a voltage controller included in the electroluminescent display of FIG. 10.

Referring to FIGS. 7 and 11, a voltage controller 20*c* includes a voltage calculator VCAL, a comparator COM, a first calculator CAL1, a second calculator CAL2, a third calculator CAL3, a fourth calculator CAL4 and a control signal generator CSG. In comparison with the voltage controller 20*a* of FIG. 8, the voltage controller 20*c* of FIG. 11 further includes the voltage calculator VCAL and the comparator COM. The other elements are substantially the same and repeated descriptions are omitted.

The voltage calculator VCAL can calculate an average grayscale value of input image data DIN and calculate the supply voltage level SVLC of the high power supply voltage ELVDD based on the average grayscale value. The comparator COM can receive the voltage detection signal VDET representing the sensed supply voltage level SVLS of the high power supply voltage ELVDD. The comparator COM can compare the sensed supply voltage level SVLS and the calculated supply voltage level SVLC and determine a greater voltage level of the sensed supply voltage level SVLS and the calculated supply voltage level SVLC as the supply voltage level SVL of the high power supply voltage ELVDD (S510).

The first calculator CAL1 can calculate an ohmic drop VDR of the high power supply voltage ELVSS based on the current detection signal CDET (S520). The second calculator CAL2 can calculate a local voltage level LVL of the high power supply voltage ELVDD by subtracting the ohmic drop VDR from the supply voltage level SVL of the high power supply voltage ELVDD (S530). The third calculator CAL3 can calculate a first target voltage level TVL1 by subtracting a first voltage offset VOFS1 from the local voltage level LVL (S541). The fourth calculator CAL4 can calculate a second target voltage level TVL2 by subtracting a second voltage offset VOFS2 from the local voltage level LVL (S551), where the second voltage offset VOFS2 is greater than the first voltage offset VOFS1. The control signal generator CSG can generate a first voltage control signal VCTRL1 and a second voltage control signal VCTRL2 based on the first target voltage level TVL1 and the second target voltage level TVL2, respectively. The power supply unit 30 in FIG. 2 can generate the high data voltage VDH based on the first voltage control signal VCTRL1 (S542), and generate the low data voltage VDL based on the second voltage control signal VCTRL2 (S552).

Figure 12:
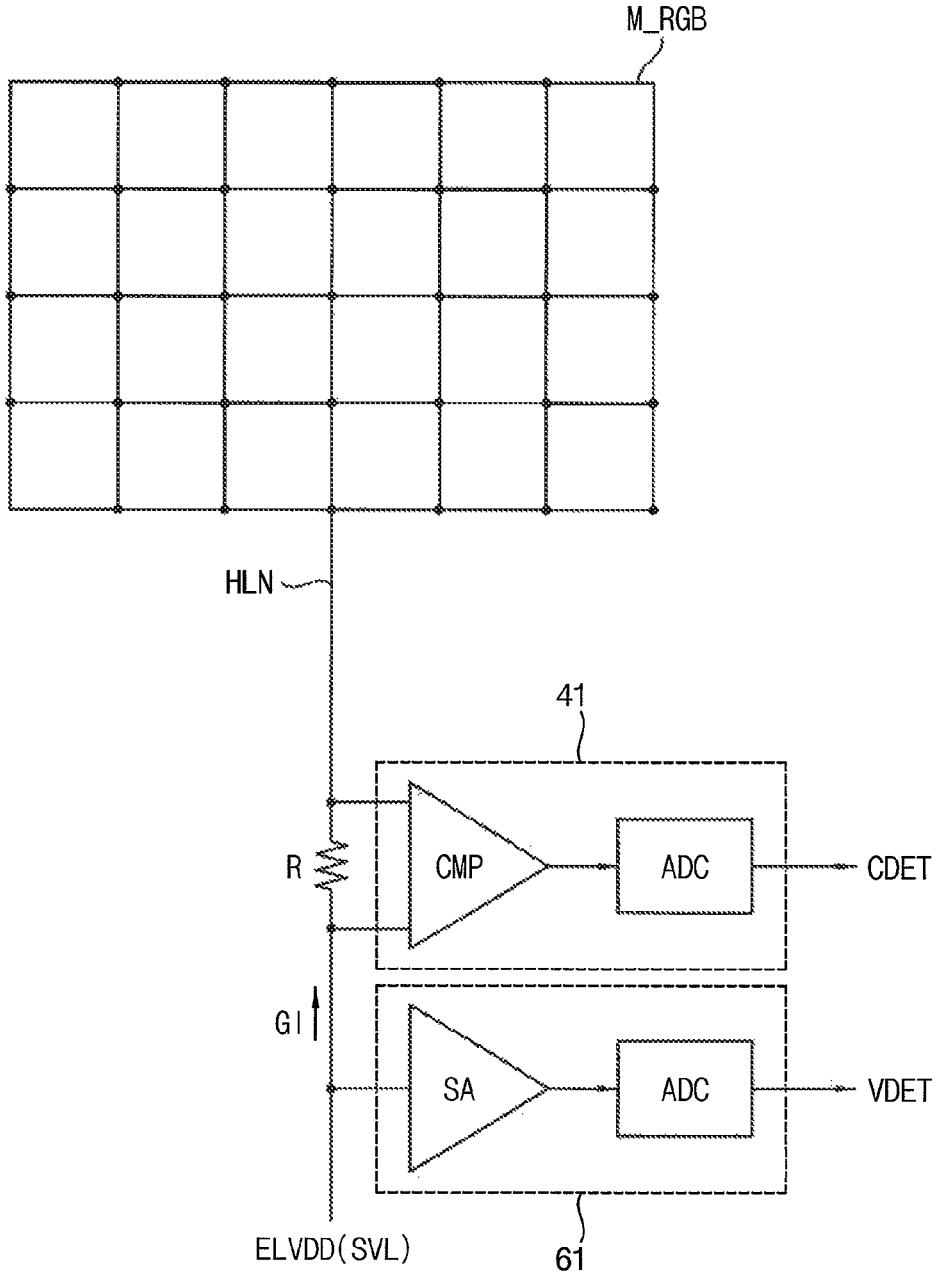
FIG. 12 is a diagram illustrating wiring for a high power supply voltage, a current detection unit and a voltage detection unit included in the electroluminescent display of FIG. 10.

FIG. 12 is a diagram illustrating wiring for a high power supply voltage, a current detection unit (or current detector) and a voltage detection unit (or voltage detector) included in the electroluminescent display of FIG. 10.

Referring to FIG. 12, high power supply voltage wiring M_RGB is formed in the display panel. The high power supply voltage wiring M_RGB can provide a path for providing the high power supply voltage ELVDD to the red pixels, the green pixels and the blue pixels in the display panel. FIG. 12 illustrated a non-limiting example that the wiring M_RGB is implemented with a mesh structure to substantially uniformly provide the high power supply voltage ELVDD to the pixels distributed in the display panel.

Referring to FIGS. 10 and 12, the current detection unit 41 includes an amplifier CMP coupled to the voltage supply line HLN and an analog-to-digital converter ADC. The amplifier CMP or the comparator can output an analog signal corresponding to a voltage difference between both ends of the resistor R, and the analog-to-digital converter ADC can convert the analog signal to a digital signal to generate the current detection signal CDET representing the global current GI. The voltage detection unit 61 can include a sense amplifier SA coupled to the voltage supply line HLN and an analog-to-digital converter ADC. The sense amplifier SA can amplify the voltage on the voltage supply line HLN to output an analog signal. The analog-to-digital converter ADC can convert the analog signal to a digital signal to generate the voltage detection signal VDET representing the supply voltage level SVL of the high power supply voltage ELVDD.

The voltage controller 21 can generate the voltage control signal VCTRL such that at least one of the high data voltage VDH and the low data voltage VDL can be varied based on the current detection signal CDET representing the global current GI and the voltage detection signal representing the supply voltage level SVL of the high power supply voltage ELVDD.

Figure 13:
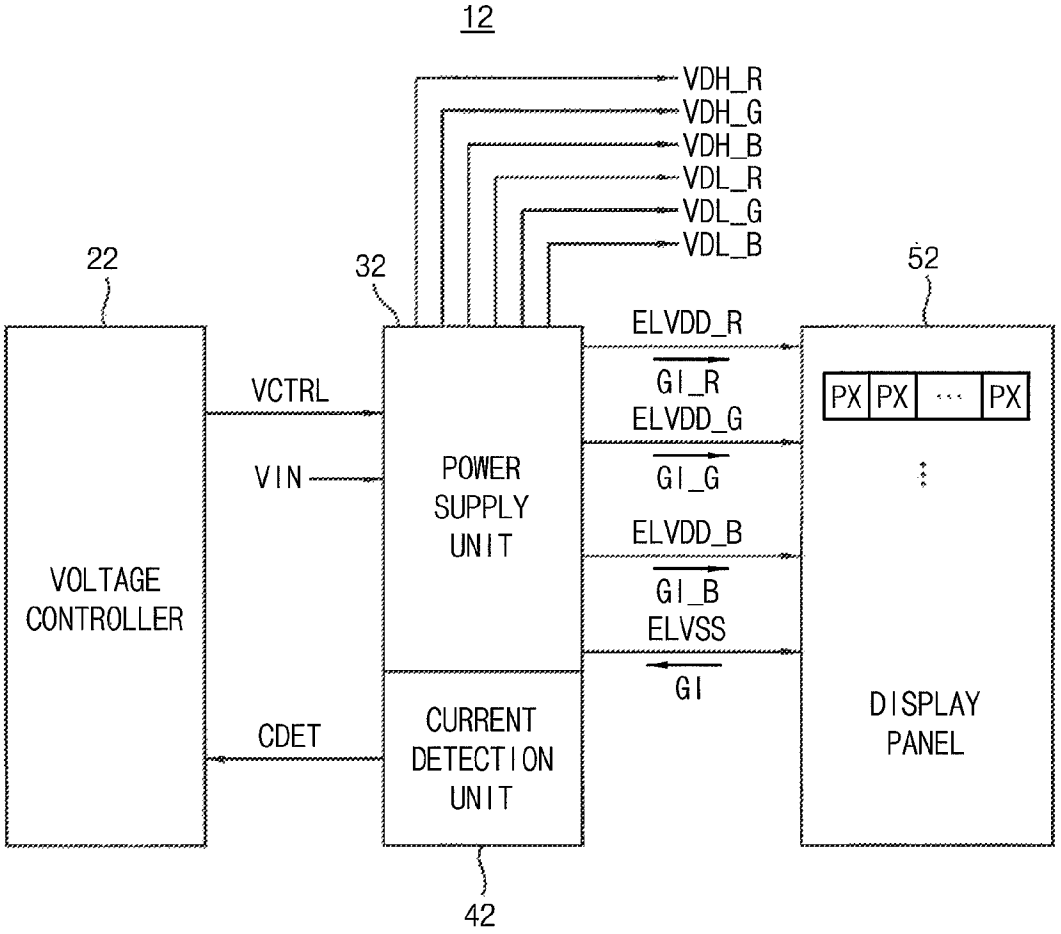
FIG. 13 is a block diagram illustrating an electroluminescent display according to example embodiments.

FIG. 13 is a block diagram illustrating an electroluminescent display according to example embodiments.

Referring to FIG. 13, an electroluminescent display 12 includes a voltage controller 22, a power supply unit or power supply 32, a current detection unit or current detector 42 and a display panel 52. The current detection unit 42 can be included in the power supply unit 32 or disposed out of the power supply unit 32.

The display panel 52 includes a plurality of pixels PX operating based on a red high power supply voltage ELVDD_R, a green high power supply voltage ELVDD_G, a blue high power supply voltage ELVDD_B and a low power supply voltage ELVSS.

The power supply unit 32 generates the red high power supply voltage ELVDD_R, the green high power supply voltage ELVDD_G, the blue high power supply voltage ELVDD_B, the low power supply voltage ELVSS, a red high data voltage VDH_R, a green high data voltage VDH_G, a blue high data voltage VDH_B, a red low data voltage VDL_R, a green low data voltage VDL_G and a blue low data voltage VDL_B based on based on an input voltage VIN and a voltage control signal VCTRL. The power supply unit 32 can include a boost converter generating a high positive voltage, an inverting buck-boost converter generating a negative voltage, etc. The input voltage VIN provided to the power supply unit 32 can be an AC voltage or a DC voltage from a battery, and the voltage converters in the power supply unit 32 can be an AC-DC converter or a DC-DC converter.

The current detection unit 42 senses a red global current GI_R, a green global current GI_G and a blue global current GI_B provided to the display panel 50 and generates a current detection signal CDET. The operations of the current detection unit 42 are further described with reference to FIG. 14. The sum of the red, green and blue global currents GI_R, GI_G and GI_B can correspond to the global current GI.

The voltage controller 22 generates a voltage control signal VCTRL, such that at least one of the high data voltages VDH_R, VDH_G and VDH_B and the low data voltages VDL_R, VDL_G and VDL_B can be varied based on the current detection signal CDET provided from the current detection unit 42. The voltage controller 22 also provides the voltage control signal VCTRL to the power supply unit 32. The voltage controller 22 can adjust the voltage control signal VCTRL to control the voltage levels of the high power supply voltages ELVDD_R, ELVDD_G and ELVDD_B, the low power supply voltage ELVSS, the high data voltages VDH_R, VDH_G and VDH_B and the low data voltages VDL_R, VDL_G and VDL_B generated by the power supply unit 32, respectively. The voltage control signal VCTRL can include a plurality of control signals for respectively controlling the voltages.

As described above, the electroluminescent display 12 can vary the high data voltages VDH_R, VDH_G and VDH_B based on the current detection signal CDET so that a gate-source voltage of a driving transistor in each pixel for turning off the driving transistor can be maintained substantially uniformly. In addition, the electroluminescent display 12 can vary the low data voltages VDL_R, VDL_G and VDL_B based on the current detection signal CDET so that the gate-source voltage for turning on the driving transistor can be maintained substantially uniformly.

As such, the electroluminescent display 12 according to example embodiments reduces power consumption of the electroluminescent display 12 and enhances quality of the displayed images by varying the high data voltage VDH and/or the low data voltage VDL so that the gate-source voltage for turning on or off the driving transistor can be maintained substantially uniformly.

Figure 14:
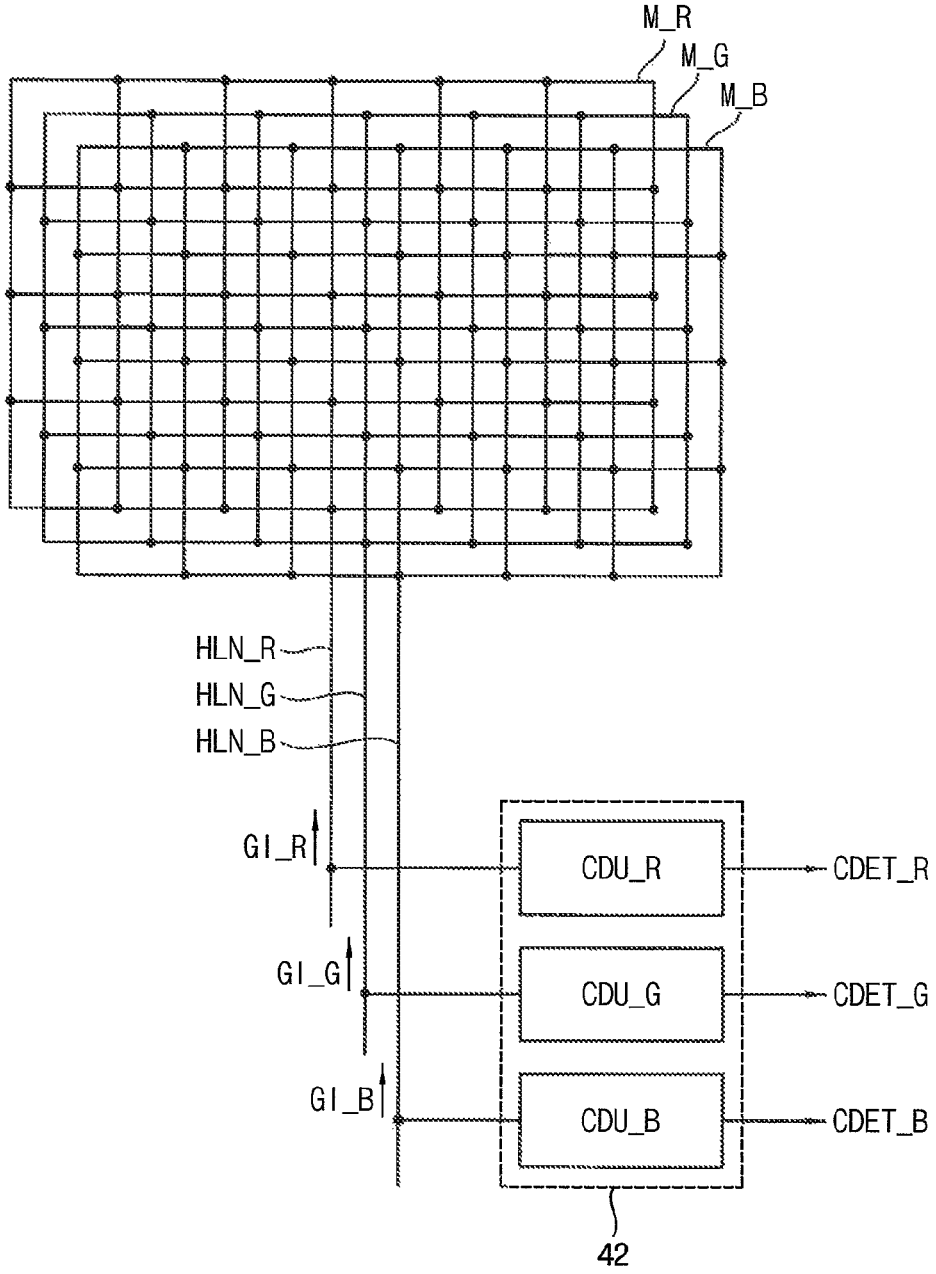
FIG. 14 is a diagram illustrating wiring for a high power supply voltage and a current detection unit included in the electroluminescent display of FIG. 13.

FIG. 14 is a diagram illustrating wiring for a high power supply voltage and a current detection unit included in the electroluminescent display of FIG. 13.

Referring to FIG. 14, red high power supply voltage wiring M_R, green high power supply voltage wiring M_G and blue high power supply voltage wiring M_B are formed in the display panel. The red high power supply voltage wiring M_R can provide a path for providing the red high power supply voltage ELVDD_R to the red pixels, the green high power supply voltage wiring M_G can provide a path for providing the green high power supply voltage ELVDD_G to the green pixels and the blue high power supply voltage wiring M_B can provide a path for providing the blue high power supply voltage ELVDD_B to the blue pixels. FIG. 14 illustrates a non-limiting example that the wirings M_R, M_G and M_B are implemented with a mesh structure to substantially uniformly provide the high power supply voltages ELVDD_R, ELVDD_G and ELVDD_B to the pixels distributed in the display panel.

Referring to FIGS. 13 and 14, the current detection unit 42 includes a red current detection unit or red current detector CDU_R, a green current detection unit or green current detector CDU_G and a blue current detection unit or blue current detector CDU_B. The red current detection unit CDU_R can generate a red current detection signal CDET_R by sensing the red global current GI_R provided to the red pixels in the display panel. The green current detection unit CDU_G can generate a green current detection signal CDET_G by sensing the green global current GI_G provided to the green pixels in the display panel. The blue current detection unit CDU_B can generate a blue current detection signal CDET_B by sensing the blue global current GI_B provided to the blue pixels in the display panel.

The red global current GI_R can correspond to the sum of the driving currents of the red pixels and the current on a red voltage line HLV_R connecting the red high power supply voltage wiring M_R, and the power supply unit 32 can be measured as the red global current GI_R. The green global current GI_G can correspond to the sum of the driving currents of the green pixels and the current on a green voltage line HLV_G connecting the green high power supply voltage wiring M_G, and the power supply unit 32 can be measured as the green global current GI_G. The blue global current GI_B can correspond to the sum of the driving currents of the blue pixels and the current on a blue voltage line HLV_B connecting the blue high power supply voltage wiring M_B, and the power supply unit 32 can be measured as the blue global current GI_B.

The voltage controller 22 can generate the voltage control signal VCTRL such that the red, green and blue high data voltages VDH_R, VDH_G and VDH_B can be respectively varied based on the red, green and blue current detection signals CDET_R, CDET_G and CDET_B. In addition, the voltage controller 22 can generate the voltage control signal VCTRL such that the red, green and blue low data voltages VDL_R, VDH_G and VDL_B can be varied based on the red, green and blue current detection signals CDET_R, CDET_G and CDET_B.

As such, the current detection unit 42 can generate the current detect signals CDET_R, CDET_G and CDET_B independently with respect to the red, green and blue pixels, and the voltage controller 22 can control the voltage levels of the high data voltage VDH_R, VDH_G and VDH_B and/or the low data voltages VDL_R, VDL_G and VDL_B independently based on the current detection signals CDET_R, CDET_G and CDET_B.

Figure 15:
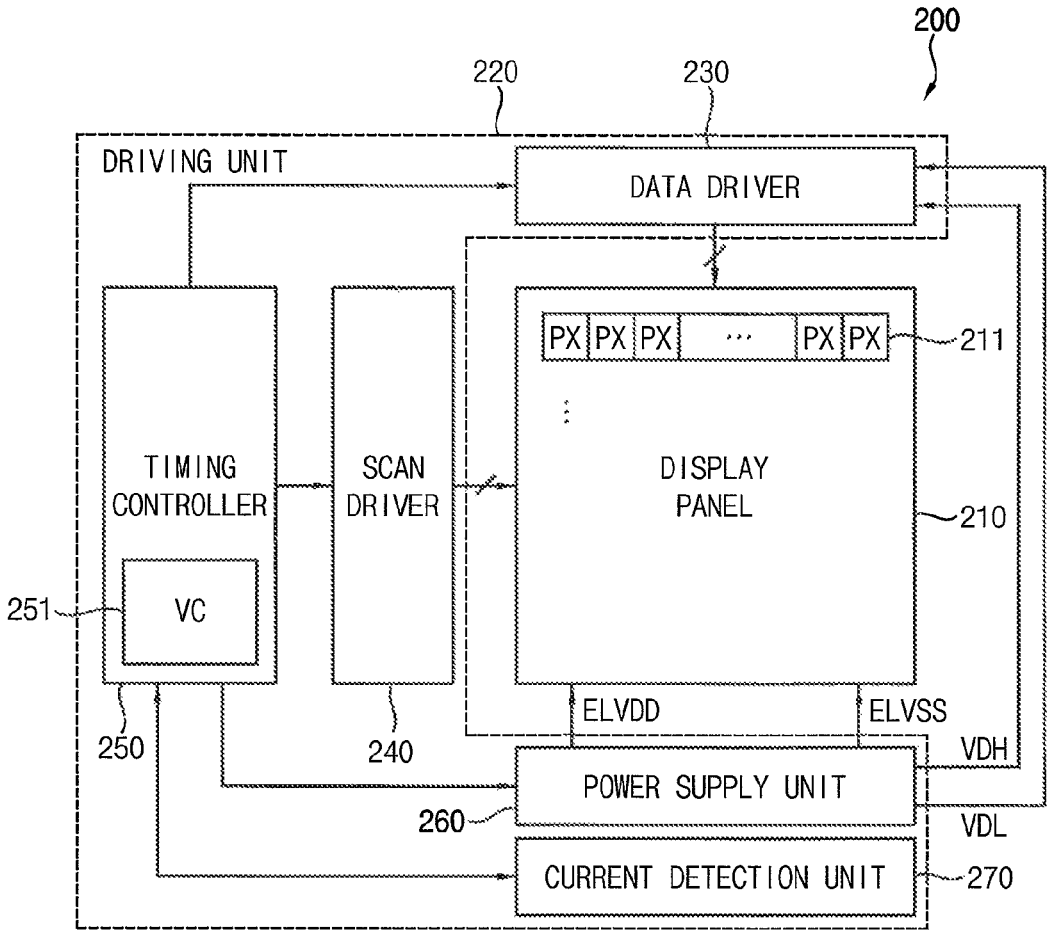
FIG. 15 is a block diagram illustrating an electroluminescent display according to example embodiments.

FIG. 15 is a block diagram illustrating an electroluminescent display according to example embodiments. FIG. 16 is a circuit diagram illustrating an example of a pixel included in the electroluminescent display of FIG. 15.

Referring to FIG. 15, an electroluminescent display 200 includes a display panel 210 including a plurality of pixel rows 211 and a driving unit or driver 220 that drives the display panel 210. The driving unit 220 can include a data driver 230, a scan driver 240, a timing controller 250, a power supply unit 260, a current detection unit or current detector 270 and a voltage controller VC 251.

The display panel 210 can be connected to the data driver 230 through a plurality of data lines and can be connected to the scan driver 240 through a plurality of scan lines. The display panel 210 can include the pixel rows 211. That is, the display panel 210 can include a plurality of pixels PX arranged in a matrix having a plurality of rows and a plurality of columns. One row of pixels PX connected to the same scan line can be referred to as one pixel row 211. In some embodiments, the display panel 210 is a self-emitting display panel that emits light without the use of a back light unit. For example, the display panel 210 is an OLED display panel.

In some embodiments, as illustrated in FIG. 16, each pixel PX of the display panel 210 includes a switching transistor ST, a storage capacitor CST, a driving transistor DT and an OLED.

The switching transistor ST has a first source/drain terminal connected to a data line, a second source/drain terminal connected to the storage capacitor CST, and a gate terminal connected to the scan line. The switching transistor ST transfers a data signal SDATA received from the data driver 230 to the storage capacitor CST in response to a scan signal SSCAN received from the scan driver 240.

The storage capacitor CST has a first terminal connected to the high power supply voltage ELVDD of the local voltage level LVL and a second terminal connected to a gate terminal of the driving transistor DT. The storage capacitor CST stores the high data voltage VDH or the low data voltage VDL of the data signal SDATA transferred through the switching transistor ST.

The driving transistor DT has a first source/drain terminal connected to a high power supply voltage ELVDD, a second source/drain terminal connected to the OLED, and the gate terminal connected to the storage capacitor CST. The driving transistor DT can be turned on or off according to the data signal SDATA stored in the storage capacitor CST. The OLED has an anode electrode connected to the driving transistor DT and a cathode electrode connected to a low power supply voltage ELVSS.

The OLED can emit light based on a current flowing from the high power supply voltage ELVDD to the low power supply voltage ELVSS while the driving transistor DT is turned on. This simple structure of each pixel PX, or a 2T1C structure including two transistors ST and DT and one capacitor CST, is one example of a pixel structure that is suitable for a large sized display.

The data driver 230 can apply a data signal to the display panel 210 through the data lines. The scan driver 240 can apply a scan signal to the display panel 210 through the scan lines. As described above, the voltage controller 251 can generate the voltage control signal VCTRL based on the current detection signal CDET.

The timing controller 250 can control the operation of the display 200. As illustrated in FIG. 15, the voltage controller 251 is included in the timing controller 250. For example, the timing controller 250 provides predetermined control signals to the data driver 230 and the scan driver 240 to control the operations of the display 200. In some embodiments, the data driver 230, the scan driver 240 and the timing controller 250 are implemented as one integrated circuit (IC). In other embodiments, the data driver 230, the scan driver 240 and the timing controller 250 are implemented as two or more integrated circuits.

The power supply unit 260 can supply the display panel 210 with the high power supply voltage ELVDD and the low power supply voltage ELVSS. The current detection unit 270, as described above, can generate the current detection signal CDET by sensing the global current GI provided to the display panel 210.

As illustrated in FIGS. 15 and 16, the power supply unit 260 provides the high data voltage VDH and the low data voltage VDL to the data driver 230. The data driver 230 can generate the data signals SDATA having the voltage levels of the high data voltage VDH or the low data voltage VDL based on the input image data. Each data signal can be applied to the gate terminal or the gate electrode of the driving transistor DT in each pixel. For example, the high data voltage VDH or the low data voltage VDL as the voltage levels of the data signal SDATA is applied to the gate electrode of the driving transistor DT.

Figure 17:
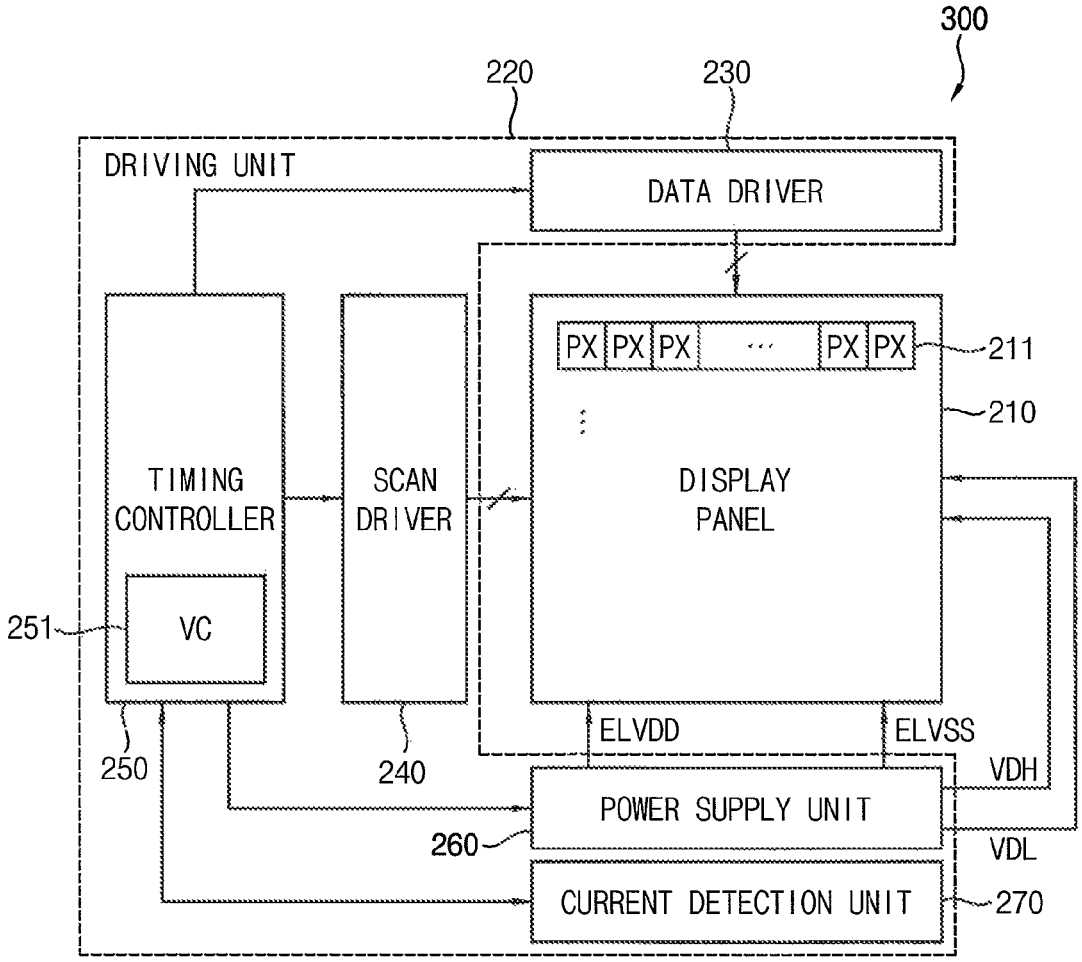
FIG. 17 is a block diagram illustrating an electroluminescent display according to example embodiments.

FIG. 17 is a block diagram illustrating an electroluminescent display according to example embodiments. FIG. 18 is a circuit diagram illustrating an example of a pixel included in the electroluminescent display of FIG. 17.

While the high data voltage VDH and the low data voltage VDL are provided to the data driver 230 in the electroluminescent display 200 of FIG. 15, the high data voltage VDH and the low data voltage VDL are provided to the display panel 210 in the electroluminescent display 300 of FIG. 17. The descriptions repeated with FIG. 15 are omitted.

In some embodiments, as illustrated in FIG. 18, each pixel of the display panel 210 includes a first voltage selection transistor VT1, a second voltage selection transistor VT2, an inverter INV, a first switching transistor ST1, a second switching transistor ST2, a storage capacitor CST, a driving transistor DT and an OLED.

The first voltage selection transistor VT1 has a first source/drain terminal connected to the low data voltage VDL, a second source/drain terminal connected to the first switching transistor ST1, and a gate terminal connected to the data signal SDATA. The second voltage selection transistor VT2 has a first source/drain terminal connected to the high data voltage VDH, a second source/drain terminal connected to the second switching transistor ST2, and a gate terminal connected to an output of the inverter INV, that is, an inversion signal of the data signal SDATA.

The first voltage selection transistor VT1 and the second voltage selection transistor VT2 can select and transfer one of the high data voltage VDH and the low data voltage VDL depending on the logic level of the data signal SDATA. When the data signal SDATA has a logic low level LL, the first voltage selection transistor VT1 is turned on and the low data voltage VDL is transferred to the first switching transistor ST1. In contrast, when the data signal SDATA has a logic high level HL, the second voltage selection transistor VT2 is turned on and the high data voltage VDH is transferred to the second switching transistor ST2.

The first switching transistor ST1 has a first source/drain terminal connected to the first voltage selection transistor VT1, a second source/drain terminal connected to the storage capacitor CST, and a gate terminal connected to the scan signal SSCAN. The second switching transistor ST2 has a first source/drain terminal connected to the second voltage selection transistor VT2, a second source/drain terminal connected to the storage capacitor CST, and a gate terminal connected to the scan signal SSCAN. The switching transistors ST1 and ST2 can transfer the high data voltage VDH or the low data voltage VDL, which can be transferred selectively from the voltage selection transistors VT1 and VT2, to the storage capacitor CST in response to the scan signal SSCAN from the scan driver 240.

The storage capacitor CST has a first terminal connected to the high power supply voltage ELVDD of the local voltage level LVL and a second terminal connected to a gate terminal of the driving transistor DT. The storage capacitor CST can store the high data voltage VDH or the low data voltage VDL that can be transferred selectively through the voltage selection transistors VT1 and VT2 and the switching transistors ST1 and ST2.

The driving transistor DT has a first source/drain terminal connected to a high power supply voltage ELVDD, a second source/drain terminal connected to the OLED, and the gate terminal connected to the storage capacitor CST. The driving transistor DT can be turned on or off according to the high data voltage VDH or the low data voltage VDL stored in the storage capacitor CST.

The OLED has an anode electrode connected to the driving transistor DT and a cathode electrode connected to a low power supply voltage ELVSS. The OLED can emit light based on a current flowing from the high power supply voltage ELVDD to the low power supply voltage ELVSS while the driving transistor DT is turned on.

As illustrated in FIGS. 17 and 18, the power supply unit 260 provides the high data voltage VDH and the low data voltage VDL to the display panel 210. The data driver 230 can generate the data signals SDATA having the logic high level HL or the logic low level LL based on the input image data. Each data signal can be applied to the gate terminal or the gate electrode of the driving transistor DT in each pixel. For example, the high data voltage VDH or the low data voltage VDL as the voltage levels of the data signal SDATA is applied to the gate electrode of the driving transistor DT. The high data voltage VDH or the low data voltage VDL is applied to the gate terminal or the gate electrode of the driving transistor DT in each pixel PX in response to each data signal SDATA.

Figure 19:
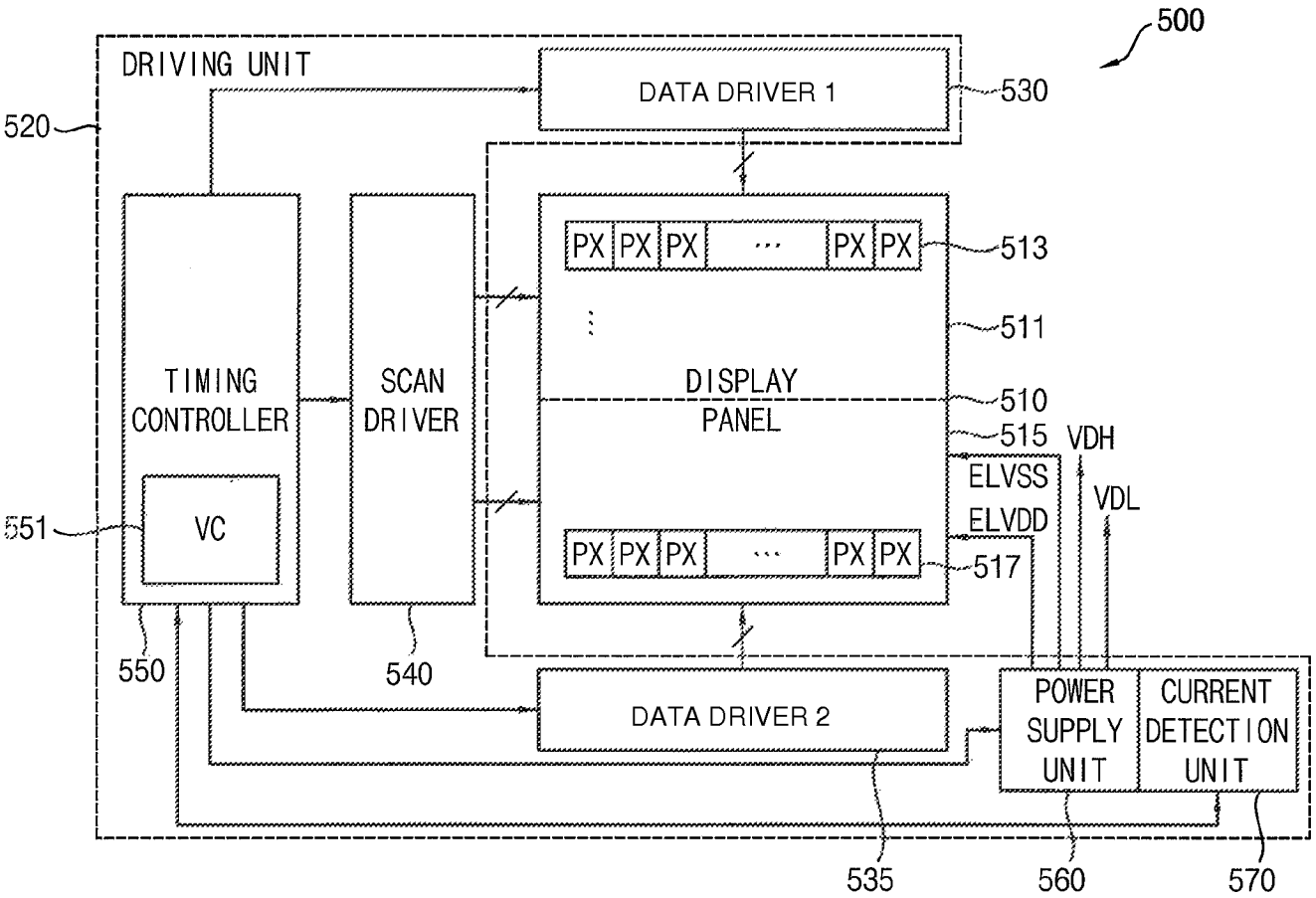
FIGS. 19 and 20 are block diagrams illustrating an electroluminescent display according to example embodiments.

FIG. 19 is a block diagram illustrating an electroluminescent display according to example embodiments.

Referring to FIG. 19, an electroluminescent display 500 include a display panel 510 and a driving unit or driver 520 that drives the display panel 510. The driving unit 520 includes first and second data drivers 530 and 535, a scan driver 540, a timing controller 550, a power supply unit 560, a current detection unit 570 and a voltage controller VC 551. The display 500 of FIG. 19 has a similar configuration to the display 200 of FIG. 15, except that the display 500 includes two data drivers 530 and 535 and the display panel 510 includes upper and lower display panels 511 and 515 that are respectively driven by the different data drivers 530 and 535, and thus repeated descriptions are omitted.

The display panel 510 can be divided into the upper display panel 511 including upper pixel rows 513 and the lower display panel 515 including lower pixel rows 517. The upper pixel rows 513 of the upper display panel 511 can receive data signals from the first data driver 530 and the lower pixel rows 517 of the lower display panel 515 can receive data signals from the second data driver 535. Thus, the upper pixel rows 513 can be respectively driven by different data drivers 530 and 535. In some embodiments, the scan driver 540 provides scan signals to the upper display panel 511 and the lower display panel 515. In other embodiments, the display 500 includes two scan drivers respectively providing the scan signals to the upper display panel 511 and the lower display panel 515.

In some embodiments, the high data voltage VDH and the low data voltage VDL are provided to the data drivers 530 and 535 as described with reference to FIGS. 15 and 16. In some embodiments, the high data voltage VDH and the low data voltage VDL are provided to the display panel 510 as described with reference to FIGS. 17 and 18.

Figure 20:
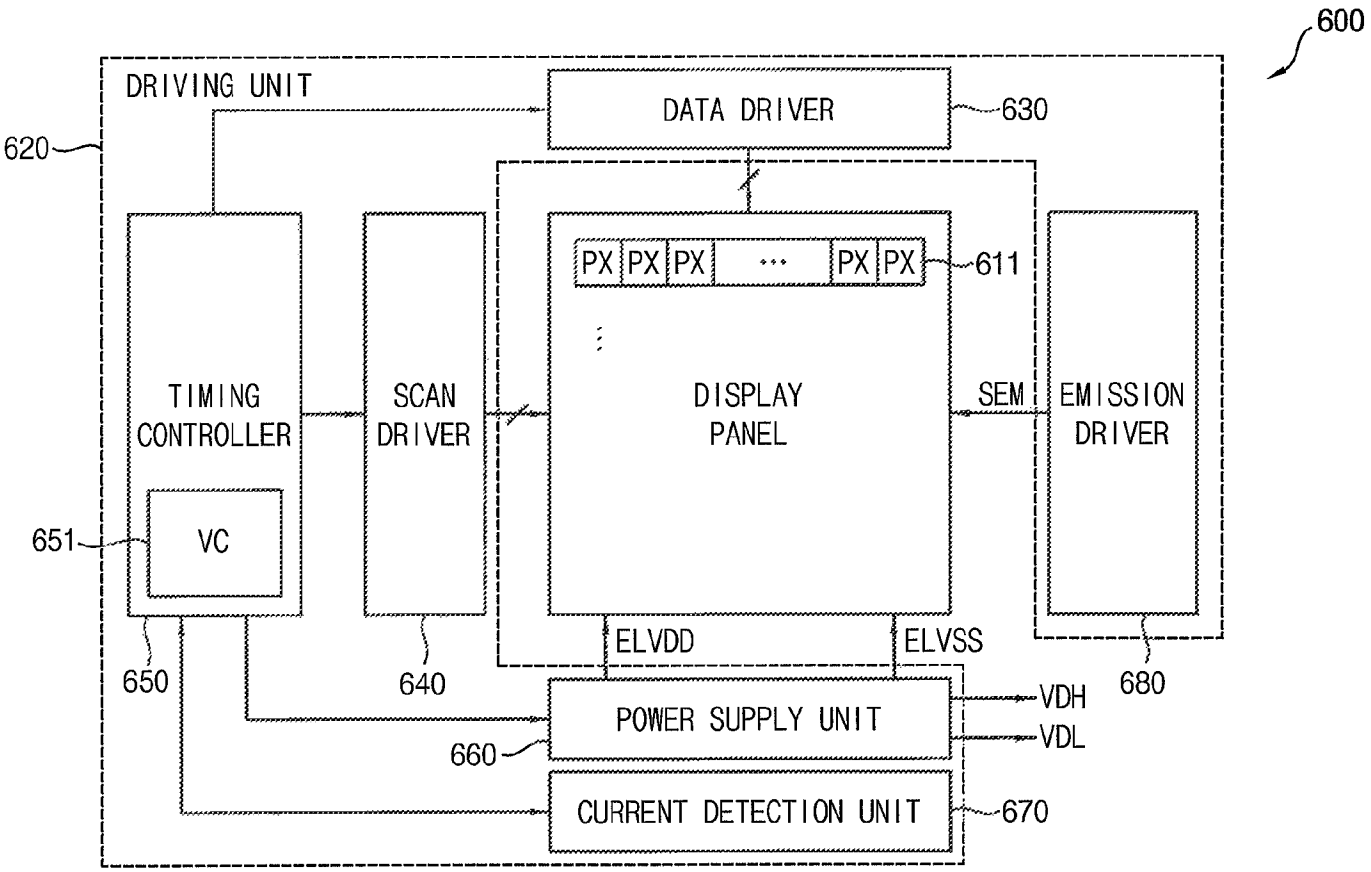

FIG. 20 is a block diagram illustrating an electroluminescent display according to example embodiments. FIG. 21 is a circuit diagram illustrating an example of a pixel included in the electroluminescent display of FIG. 20.

Referring to FIG. 20, an electroluminescent display 600 can include a display panel 610 including a plurality of pixel rows 611 and a driving unit or driver 620 that drives the display panel 610. The driving unit 620 can include a data driver 630, a scan driver 640, a timing controller 650, a power supply unit or power supply 660, a current detection unit or current detector 670, an emission driver 680 and a voltage controller 651.

The display 600 of FIG. 20 can have a similar configuration to the display 200 of FIG. 15, except that the display 600 includes the emission driver 680 and that each pixel PX of FIG. 21 further includes an emission control transistor, and thus repeated descriptions are omitted.

The emission control driver 680 can substantially simultaneously or concurrently apply an emission control signal SEM to all pixels PX included in the display panel 610 to control the all pixels PX to substantially simultaneously or concurrently emit or not emit light. For example, the emission control driver 680 substantially simultaneously or concurrently applies the emission control signal SEM having a first voltage level to all pixels PX during a non-emission time such that the all pixels PX do not emit light and can substantially simultaneously or concurrently apply the emission control signal SEM having a second voltage level to all pixels PX during an emission time such that the all pixels PX substantially simultaneously or concurrently emit light.

Each pixel PX can emit or do not emit light in response to the emission control signal SEM. In some embodiments, as illustrated in FIG. 21, each pixel PX includes a switching transistor ST, a storage capacitor CST, a driving transistor DT, an emission control transistor ET and an OLED. For example, the emission control transistor ET is turned off in response to the emission control signal SEM having the first voltage level and is turned on in response to the emission control signal SEM having the second voltage level. The OLED can emit light based on a current flowing from the high power supply voltage ELVDD to the low power supply voltage ELVSS while the driving transistor DT and the emission control transistor ET are turned on.

In some embodiments, the high data voltage VDH and the low data voltage VDL are provided to the data driver 630 as described with reference to FIGS. 15 and 16. In this case, each pixel in the display panel 610 can have a configuration equal to or similar to that of FIG. 21. In some embodiments, the high data voltage VDH and the low data voltage VDL are provided to the display panel 610 as described with reference to FIGS. 17 and 18. In this case, even though not illustrated, each pixel in the display panel 610 can have a configuration such that an emission control transistor ET is added to a configuration equal to or similar to that of FIG. 18.

Figure 22:
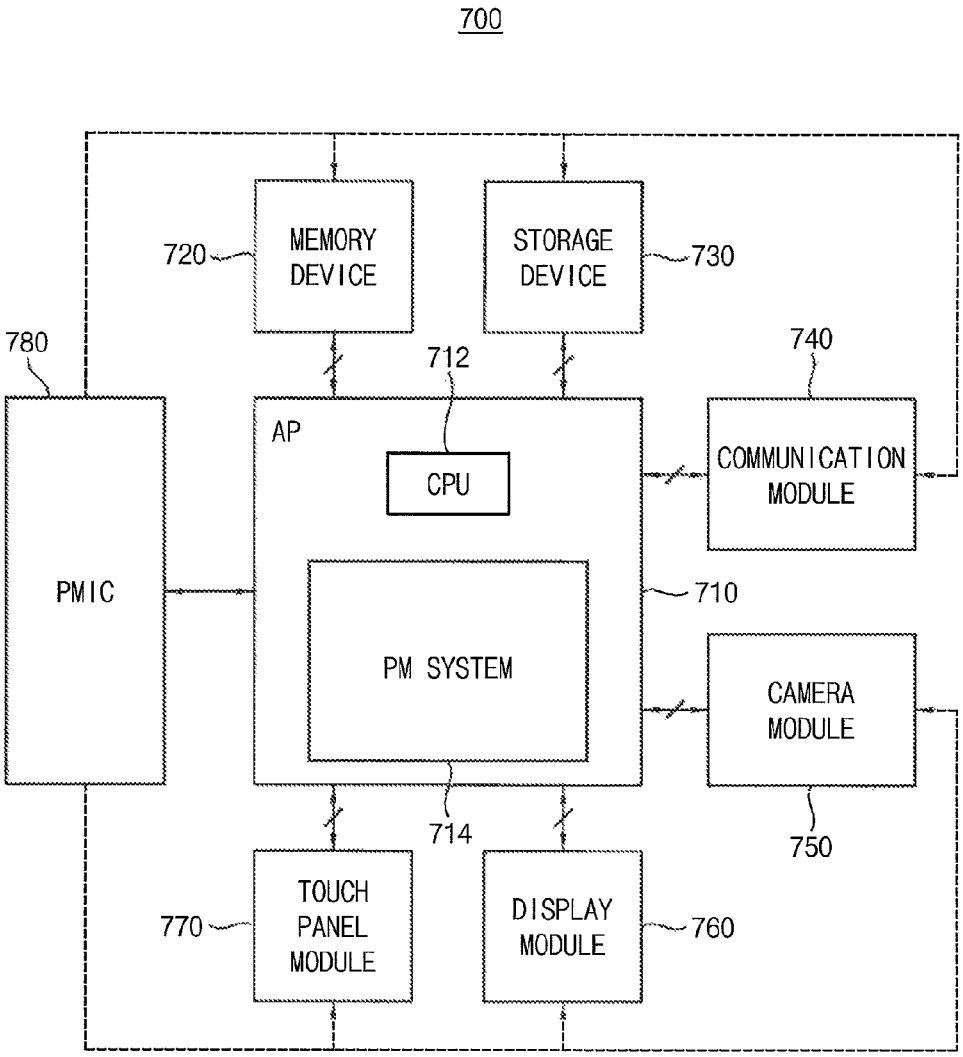
FIG. 22 is a block diagram illustrating a mobile according to example embodiments.

FIG. 22 is a block diagram illustrating a mobile device according to example embodiments.

Referring to FIG. 22, a mobile device 700 includes a system on chip (SoC) 710 and a plurality of functional modules 740, 750, 760 and 770. The mobile device 700 can further include a memory device 720, a storage device 730 and a power management 780.

The SoC 710 controls overall operations of the mobile device 700. For example, the SoC 710 controls the memory device 720, the storage device 730 and the plurality of functional modules 740, 750, 760 and 770. The SoC 710 can be an application processor (AP) that is included in the mobile device 700.

The SoC 710 can include a CPU 712 and a power management system 714. The memory device 720 and the storage device 730 can store data for operations of the mobile device 700. The memory device 720 can include a volatile memory device, such as a dynamic random access memory (DRAM), a SRAM, a mobile DRAM, etc. The storage device 730 can include a nonvolatile memory device, such as an erasable programmable read-only memory (EPROM), an electrically erasable programmable read-only memory (EEPROM), a flash memory, a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), etc. In some embodiments, the storage device 730 further includes a solid state drive (SSD), a hard disk drive (HDD), a CD-ROM, etc.

The functional modules 740, 750, 760 and 770 perform various functions of the mobile device 700. For example, the mobile device 700 includes a communication module 740 that performs a communication function (e.g., a code division multiple access (CDMA) module, a long term evolution (LTE) module, a radio frequency (RF) module, an ultra-wideband (UWB) module, a wireless local area network (WLAN) module, a worldwide interoperability for a microwave access (WIMAX) module, etc.), a camera module 750 that performs a camera function, a display module 760 that performs a display function, a touch panel module 770 that performs a touch sensing function, etc. In some embodiments, the mobile device 700 further includes a global positioning system (GPS) module, a microphone (MIC) module, a speaker module, a gyroscope module, etc. However, the functional modules 740, 750, 760, and 770 in the mobile device 700 are not limited thereto.

The power management device 780 can provide an operating voltage to the SoC 710, the memory device 720, the storage device 730 and the functional modules 740, 750, 760 and 770.

In some embodiments, the display module 760 includes the current detection unit and the voltage controller for the above-described adaptive voltage control. The current detection unit can sense the global current GI provided to the display panel to generate the current detection signal CDET. The voltage controller can vary at least one of the high data voltage VDH and the low data voltage VDL based on the current detection signal CDET. Power consumption of the electroluminescent display can be reduced and quality of the displayed images can be enhanced by varying the high data voltage VDH and/or the low data voltage VDL so that the gate-source voltage for turning on or off the driving transistor can be maintained substantially uniformly.

Figure 23:
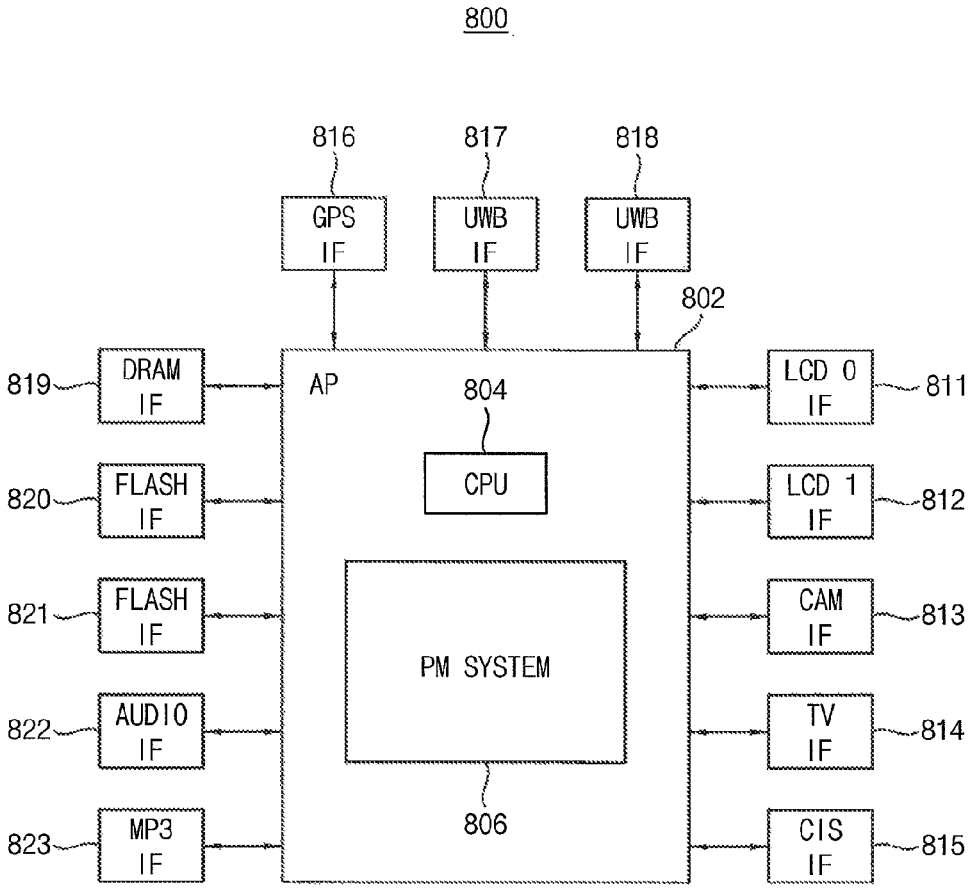
FIG. 23 is a block diagram illustrating an interface included in a mobile according to example embodiments.

FIG. 23 is a block diagram illustrating an interface included in a mobile device according to example embodiments.

Referring to FIG. 17, a mobile device 800 includes a SoC 802 and a plurality of interfaces 811, 812, 813, 814, 815, 816, 817, 818, 819, 820, 821, 822 and 823. The mobile device 800 can be any mobile device, such as a mobile phone, a smart phone, a tablet computer, a laptop computer, a personal digital assistants (PDA), a portable multimedia player (PMP), a digital camera, a portable game console, a music player, a camcorder, a video player, a navigation system, etc.

The SoC 802 controls overall operations of the mobile device 800. For example, the SoC 802 is an application processor (AP) that is included in the mobile device 800.

The SoC 802 can communicate with each of a plurality of peripheral devices (not illustrated) via each of the interfaces 811~823. For example, each of the interfaces 811~823 transmits at least one control signal, which is output from a respective IP among a plurality of IPs implemented in each of power domains, to each of the plurality of peripheral devices.

For example, the SoC 802 controls a power state and an operation state of each flat panel display via each of display interfaces 811 and 812. The flat panel display can include a LCD, a LED display, an OLED display or an active matrix organic light-emitting diode (AMOLED) display, etc.

The SoC 802 can control a power state and an operation state of a camcorder via a camcorder interface 813, can control a power state and an operation state of a TV module via a TV interface 814, and can control a power state and an operation state of a camera module or an image sensor module via an image sensor interface 815.

The SoC 802 can control a power state and an operation state of a GPS module via a GPS interface 816, can control a power state and an operation state of a UWB module via a UWB interface 817, and can control a power state and an operation state of an universal serial bus (USB) drive via a USB drive interface 818.

The SoC 802 can control a power state and an operation state of a DRAM via a DRAM interface 819, can control a power state and an operation state of a nonvolatile memory device (e.g., a flash memory) via a nonvolatile memory interface 820 (e.g., a flash memory interface), can control a power state and an operation state of an audio module through an audio interface 821, can control a power state of a multi-format codec (MFC) through an MFC interface 822, and can control a power state of an MP3 player through an MP3 player interface 823. For example, a module or an interface can be implemented in hardware or software.

Figure 24:
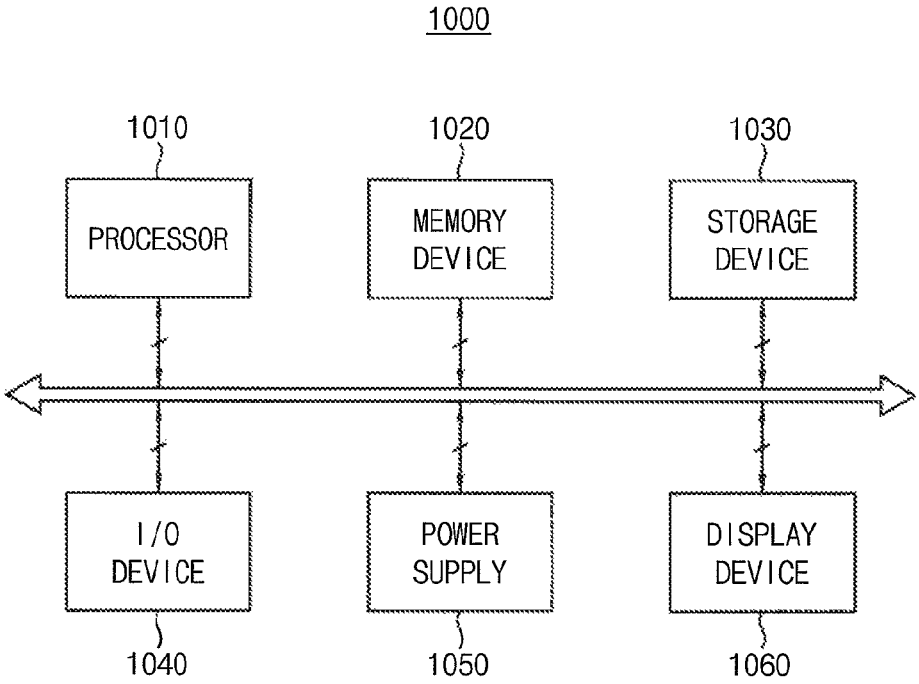
FIG. 24 is a block diagram illustrating an electronic including a display according to example embodiments.

FIG. 24 is a block diagram illustrating an electronic device including a display device according to example embodiments.

Referring to FIG. 24, the electronic device 1000 includes a processor 1010, a memory device 1020, a storage device 1030, an input/output (I/O) device 1040, a power supply 1050, and a display device 1060. The electronic device 1000 can further include a plurality of ports for communicating a video card, a sound card, a memory card, a universal serial bus (USB) device, other electronic devices, etc.

The processor 1010 can perform various computing functions. The processor 1010 can be a microprocessor, a central processing unit (CPU), etc. The processor 1010 can be coupled to other components via an address bus, a control bus, a data bus, etc. Further, the processor 1010 can be coupled to an extended bus, such as a peripheral component interconnection (PCI) bus. The memory device 1020 can store data for operations of the electronic device 1000. For example, the memory device 1020 includes at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device, such as a dynamic random access memory (DRAM) device, a static random access memory (SRAM) device, a mobile dynamic random access memory (mobile DRAM) device, etc. The storage device 1030 can be a solid state drive (SSD) device, a hard disk drive (HDD) device, a CD-ROM device, etc.

The I/O device 1040 can be an input device such as a keyboard, a keypad, a mouse, a touchpad, a touch-screen, a remote controller, etc., and an output device such as a printer, a speaker, etc. The power supply 1050 can provide a power for operations of the electronic device 1000. The display device 1060 can communicate with other components via the buses or other communication links.

In some embodiments, the display device 1060 includes the current detection unit and the voltage controller for the above-described adaptive voltage control. The current detection unit can sense the global current GI provided to the display panel to generate the current detection signal CDET. The voltage controller can vary at least one of the high data voltage VDH and the low data voltage VDL based on the current detection signal CDET. Power consumption of the electroluminescent display can be reduced and quality of the displayed images can be enhanced by varying the high data voltage VDH and/or the low data voltage VDL so that the gate-source voltage for turning on or off the driving transistor can be maintained substantially uniformly.

The above described embodiments can be applied to various kinds of devices and systems such as mobile phones, smartphones, tablet computers, laptop computers, personal digital assistants (PDAs), portable multimedia players (PMPs), digital televisions, digital cameras, portable game consoles, music players, camcorders, video players, navigation systems, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of driving an electroluminescent display, comprising:

digitally driving a display panel including a plurality of pixels based on a first power supply voltage, a second power supply voltage lower than the first power supply voltage, a first data voltage and a second data voltage lower than the first data voltage;

sensing a global current provided to the display panel, wherein the global current includes all of a plurality of driving currents respectively flowing through the pixels;

generating a current detection signal based on the sensed global current; and varying at least one of the first and second data voltages based on the current detection signal such that a gate-source voltage of a driving transistor included in each of the pixels is maintained substantially uniformly regardless of a brightness of input image data.

2. The method of claim 1, wherein the driving transistor has the gate-source voltage configured to turn off the driving transistor, and wherein the varying includes changing the first data voltage such that the gate-source voltage is maintained substantially uniformly.

3. The method of claim 1, wherein the driving transistor having a has the gate-source voltage configured to turn on the driving transistor, and wherein the varying includes changing the second data voltage such that the gate-source voltage is maintained substantially uniformly.

4. The method of claim 1, further comprising varying the first power supply voltage provided to the display panel based on the input image data.

5. The method of claim 4, wherein varying the at least one of the first and second data voltages includes:

determining a supply voltage level of the first power supply voltage;

calculating an ohmic drop of the first power supply voltage based on the current detection signal;

subtracting the calculated ohmic drop from the supply voltage level so as to calculate a local voltage level of the first power supply voltage;

subtracting a first voltage offset from the local voltage level so as to calculate a first target voltage level; and generating the first data voltage based on the first target voltage level.

6. The method of claim 5, wherein the varying further includes:

subtracting a second voltage offset from the local voltage level so as to calculate a second target voltage level, wherein the second voltage offset is greater than the first voltage offset; and generating the second data voltage based on the second target voltage level.

7. The method of claim 5, wherein the determining includes:

calculating an average grayscale value of the input image data; and calculating the supply voltage level of the first power supply voltage provided to the display panel based on the average grayscale value.

8. The method of claim 5, wherein the determining includes sensing the supply voltage level of the first power supply voltage provided to the display panel.

9. The method of claim 5, wherein the determining includes:

calculating an average grayscale value of the input image data;

calculating the supply voltage level of the first power supply voltage provided to the display panel based on the average grayscale value;

sensing the supply voltage level of the first power supply voltage provided to the display panel; and setting the supply voltage level to one of the calculated supply voltage level and the sensed supply voltage level that has a greater level.

10. The method of claim 1, wherein the first and second data voltages are provided to a data driver included in the electroluminescent display, wherein the data driver is configured to generate a plurality of data signals having voltage levels of the first or second data voltage based on the input image data, wherein each of the pixels has the driving transistor includes a gate electrode, and wherein the data driver is further configured respectively apply each data signal to the gate electrode.

11. The method of claim 1, wherein the first and second data voltages are provided to the display panel, wherein the electroluminescent display includes a data driver configured to generate a plurality of data signals having a logic high level or a logic low level based on the input image data, wherein the driving transistor includes a gate electrode, and wherein the data driver is further configured respectively apply the first or second data voltage to the gate electrode based on each data signal.

12. The method of claim 1, further comprising varying a voltage level of the first power supply voltage based on the input image data; and fixing a voltage level of the second power supply voltage have a voltage level regardless of the input image data.

13. The method of claim 1, wherein the pixels include red, green and blue pixels wherein the generating includes:

sensing a red global current provided to the red pixels so as to generate a red current detection signal representing the red global current;

sensing a green global current provided to the green pixels so as to generate a green current detection signal representing the green global current; and sensing a blue global current provided to the blue pixels so as to generate a blue current detection signal representing the blue global current.

14. The method of claim 13, wherein the varying includes:

controlling a red first data voltage provided to the red pixels based on the red current detection signal;

controlling a green first data voltage provided to the green pixels based on the green current detection signal; and controlling a blue first data voltage provided to the blue pixels based on the blue current detection signal.

15. The method of claim 14, wherein the varying further includes:

controlling a red second data voltage provided to the red pixels based on the red current detection signal;

controlling a green second data voltage provided to the green pixels based on the green current detection signal; and controlling a blue second data voltage provided to the blue pixels based on the blue current detection signal.

16. An electroluminescent display comprising:

a display panel including a plurality of pixels configured to be driven digitally based on a first power supply voltage, a second power supply voltage lower than the first power supply voltage, a first data voltage and a second data voltage lower than the first data voltage;

a power supply configured to generate the first and second power supply voltages and the first and second data voltages based on an input voltage and a voltage control signal;

a current detector configured to sense a global current provided to the display panel to generate a current detection signal, wherein the global current includes all of a plurality of driving currents respectively flowing through the pixels; and a voltage controller configured to generate the voltage control signal based on the current detection signal so as to vary at least one of the first and second data voltages such that a gate-source voltage of a driving transistor included in each of the pixels is maintained substantially uniformly regardless of a brightness of input image data.

17. The electroluminescent display of claim 16, wherein the voltage controller includes:

a first calculator configured to calculate an ohmic drop of the first power supply voltage based on the current detection signal;

a second calculator configured to subtract the calculated ohmic drop from a supply voltage level of the first power supply voltage so as to calculate a local voltage level of the first power supply voltage;

a third calculator configured to subtract a first voltage offset from the local voltage level so as to calculate a first target voltage level;

a fourth calculator configured to subtract a second voltage offset from the local voltage level so as to calculate a second target voltage level, wherein the second voltage offset is greater than the first voltage offset; and a control signal generator configured to generate the voltage control signal based on the first and second target voltage levels.

18. The electroluminescent display of claim 17, wherein the voltage controller further includes a voltage calculator configured to calculate an average grayscale value of the input image data and calculate the supply voltage level of the first power supply voltage provided to the display panel based on the average grayscale value.

19. The electroluminescent display of claim 17, further comprising:

a voltage detector configured to sense the supply voltage level of the first power supply voltage provided to the display panel to generate a voltage detection signal representing the sensed supply voltage level.

20. The electroluminescent display of claim 16, wherein the voltage controller is further configured to vary the first data voltage such that the gate-source voltage configured to turn off the driving transistor is maintained substantially uniformly and vary the second data voltage such that the gate-source voltage configured to turn on the driving transistor is maintained substantially uniformly.

21. The method of claim 1, wherein the current detection signal is indicative of an amount of the global current.

* * * * *